US007715746B2

(12) United States Patent
Tanabe et al.

(10) Patent No.: US 7,715,746 B2
(45) Date of Patent: May 11, 2010

(54) PROCESS CARTRIDGE HAVING ELECTRICAL CONTACT AND IMAGE FORMING APPARATUS HAVING ELECTRICAL CONTACT IN URGING MEMBER

(75) Inventors: Masato Tanabe, Shizuoka-ken (JP); Susumu Nittani, Shizuoka-ken (JP); Shinjiro Toba, Odawara (JP); Tomio Noguchi, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 557 days.

(21) Appl. No.: 11/625,558

(22) Filed: Jan. 22, 2007

(65) Prior Publication Data

US 2008/0159774 A1 Jul. 3, 2008

(30) Foreign Application Priority Data

Dec. 28, 2006 (JP) ..... 2006-355651

(51) Int. Cl.
*G03G 15/00* (2006.01)
*G03G 21/18* (2006.01)

(52) U.S. Cl. ..... 399/90; 399/110; 399/111; 399/107

(58) Field of Classification Search ..... 399/90, 399/110–111, 107
See application file for complete search history.

(56) References Cited

U.S. PATENT DOCUMENTS

| | | | | |
|---|---|---|---|---|
| 6,424,811 | B1 | 7/2002 | Tsuda et al. | 399/167 |
| 6,459,869 | B2 | 10/2002 | Nittani et al. | 399/111 |
| 6,463,234 | B2 | 10/2002 | Arimitsu et al. | 399/113 |
| 6,519,431 | B1 | 2/2003 | Toba et al. | 399/111 |
| 6,542,706 | B2 | 4/2003 | Toba et al. | 399/111 |
| 6,603,939 | B1 | 8/2003 | Toba et al. | 399/103 |
| 6,678,488 | B2 | 1/2004 | Toba et al. | 399/111 |
| 6,681,088 | B2 | 1/2004 | Kanno et al. | 399/111 |
| 6,834,171 | B2 | 12/2004 | Nittani et al. | 399/103 |
| 6,836,629 | B2 | 12/2004 | Miyabe et al. | 399/111 |
| 6,898,392 | B2 | 5/2005 | Karakama et al. | 399/90 |
| 6,937,834 | B2 | 8/2005 | Kanno et al. | 399/114 |
| 6,980,758 | B2 | 12/2005 | Murayama et al. | 399/111 |
| 6,990,302 | B2 | 1/2006 | Toba et al. | 399/114 |
| 7,024,137 | B2 | 4/2006 | Nittani et al. | 399/222 |
| 7,027,756 | B2 | 4/2006 | Hoshi et al. | 399/111 |
| 7,072,603 | B2 | 7/2006 | Tsuzuki et al. | 399/111 |
| 7,088,939 | B2 | 8/2006 | Maeshima et al. | 399/111 |

(Continued)

FOREIGN PATENT DOCUMENTS

| | | |
|---|---|---|
| JP | 2004-045857 | 2/2004 |

*Primary Examiner*—David M Gray
*Assistant Examiner*—G. M. Hyder
(74) *Attorney, Agent, or Firm*—Fitzpatrick, Cella, Harper & Scinto

(57) ABSTRACT

A process cartridge detachably is mountable to a main assembly of the apparatus of an image forming apparatus including an urging member and a positioning portion. The cartridge includes a photosensitive drum; a positionable portion positioning the cartridge by engaging the positioning portion when the cartridge is mounted to the apparatus; first and second urgable portions being urged respectively, by first and second urging portions of the urging member to urge the positionable portion to the positioning portion during cartridge mounting; and an electrical contact, provided between the first and second urgable portions with respect to a horizontal direction crossing an axis of the drum, for connecting electrically to an electrical contact portion in the urging member, when the cartridge is mounted to the apparatus.

11 Claims, 17 Drawing Sheets

U.S. PATENT DOCUMENTS

| | | | | |
|---|---|---|---|---|
| 7,149,457 | B2 | 12/2006 | Miyabe et al. | 399/114 |
| 7,158,736 | B2 | 1/2007 | Sato et al. | 399/111 |
| 7,212,768 | B2 | 5/2007 | Numagami et al. | 399/111 |
| 7,215,909 | B2 | 5/2007 | Nittani et al. | 399/222 |
| 7,218,882 | B2 | 5/2007 | Toba et al. | 399/284 |
| 7,224,925 | B2 | 5/2007 | Sato et al. | 399/263 |
| 7,248,810 | B2 | 7/2007 | Miyabe et al. | 399/90 |
| 7,272,339 | B2 | 9/2007 | Tsuzuki et al. | 399/111 |
| 2003/0123896 | A1* | 7/2003 | Goto et al. | 399/90 |
| 2003/0215261 | A1* | 11/2003 | Karakama et al. | 399/111 |
| 2005/0260011 | A1 | 11/2005 | Murayama et al. | 399/111 |
| 2006/0177231 | A1 | 8/2006 | Mori et al. | 399/12 |
| 2006/0228131 | A1* | 10/2006 | Kimura et al. | 399/111 |
| 2006/0245785 | A1 | 11/2006 | Kawamura et al. | 399/111 |
| 2007/0053722 | A1 | 3/2007 | Sato et al. | 399/258 |
| 2007/0160380 | A1 | 7/2007 | Imaizumi et al. | 399/90 |
| 2007/0160384 | A1 | 7/2007 | Sakurai et al. | 399/110 |
| 2007/0160385 | A1 | 7/2007 | Noguchi et al. | 399/110 |
| 2007/0160388 | A1 | 7/2007 | Yoshimura et al. | 399/111 |
| 2007/0195146 | A1 | 8/2007 | Tanabe | 347/104 |
| 2007/0195147 | A1 | 8/2007 | Tanabe | 347/104 |
| 2008/0199204 | A1* | 8/2008 | Ishii et al. | 399/90 |

* cited by examiner

NON-DRIVE SIDE

DRIVE SIDE

NON-DRIVE SIDE

DRIVE SIDE

PROCESS CARTRIDGE HAVING ELECTRICAL CONTACT AND IMAGE FORMING APPARATUS HAVING ELECTRICAL CONTACT IN URGING MEMBER

FIELD OF THE INVENTION AND RELATED ART

The present invention relates to a process cartridge used by a copying machine, a printer, or the like which employs an electrophotographic method, and an image forming apparatus which uses a process cartridge.

Here, an image forming apparatus is an apparatus which forms an image on a recording medium with the use of an electrophotographic image forming method. As examples of an electrophotographic image forming apparatus, there are an electrophotographic copying machine, an electrophotographic printer (for example, a laser beam printer, an LED printer, etc.), a facsimile machine, a word processor, etc.

A process cartridge is: a cartridge in which a charging means, a developing means or a cleaning means, and an electrophotographic photosensitive drum are integrally disposed, and which is removably mountable in the main assembly of an electrophotographic image forming apparatus; a cartridge in which at least one among a charging means, a developing means, and a cleaning means, and an electrophotographic photosensitive drum are integrally disposed, and which is removably mountable in the main assembly of an electrophotographic image forming apparatus; or a cartridge in which at least an developing apparatus and an electrophotographic photosensitive drum are integrally disposed, and which is removably mountable in the main assembly of an electrophotographic image forming apparatus.

A process cartridge removably mountable in an image forming apparatus, and an image forming apparatus which employs a process cartridge, are required to be designed so that the contact pressure between the electrical contacts of the process cartridge and the electrical contacts of the image forming apparatus remains stable when the process cartridge is in its image forming position in the main assembly of the image forming apparatus. Thus, it has been a common practice to provide an image forming apparatus with a backup member for keeping a cartridge under pressure (Japanese Laid-open Patent Application 2004-45857).

SUMMARY OF THE INVENTION

The present invention is one of the results of further development of the above described prior art.

The primary object of the present invention is to further improve a process cartridge, and an image forming apparatus employing a process cartridge, in terms of the stability in the state of contact between the electrical contacts of the process cartridge and the electrical contacts of the main assembly of the image forming apparatus.

According to an aspect of the present invention, there is provided a process cartridge detachably mountable to a main assembly of the apparatus of an image forming apparatus. The image forming apparatus includes a main assembly urging member and a main assembly positioning portion. The process cartridge comprises: a photosensitive drum; a portion-to-be-positioned for positioning the process cartridge by engaging with the main assembly positioning portion when the process cartridge is mounted to the main assembly of the apparatus; a first portion-to-be-urged for being urged to a first urging portion of the main assembly urging member to urge the portion-to-be-positioned to the main assembly positioning portion when the process cartridge is mounted to the main assembly of the apparatus; a second portion-to-be-urged for being urged to a second urging portion of the main assembly urging member to urge the portion-to-be-positioned to the main assembly positioning portion when the process cartridge is mounted to the main assembly of the apparatus; a cartridge electrical contact, provided between the first portion-to-be-urged and the second portion-to-be-urged with respect to a horizontal direction crossing with an axis of the photosensitive drum, for connecting electrically to a main assembly electrical contact portion provided in the main assembly urging member, when the process cartridge is mounted to the main assembly of the apparatus.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENT

Embodiment 1

General Structure of Image Forming Apparatus

Figure 1:
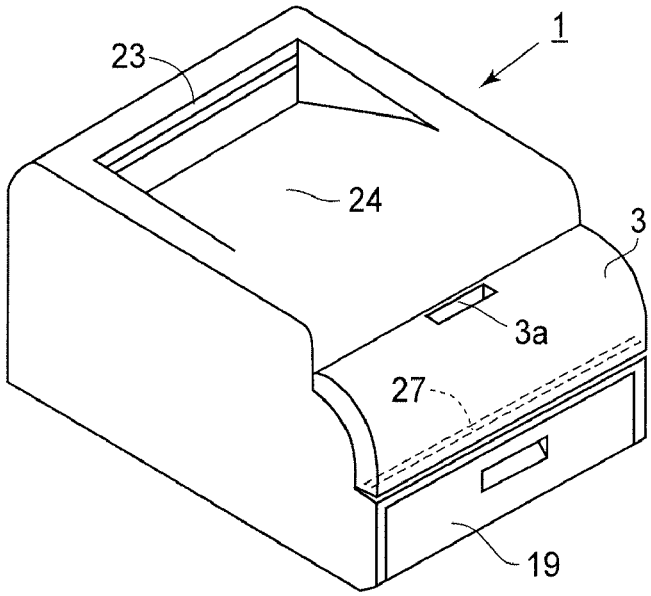
FIG. 1 is an external perspective view of the image forming apparatus in one of the preferred embodiments of the present invention.
Figure 2:
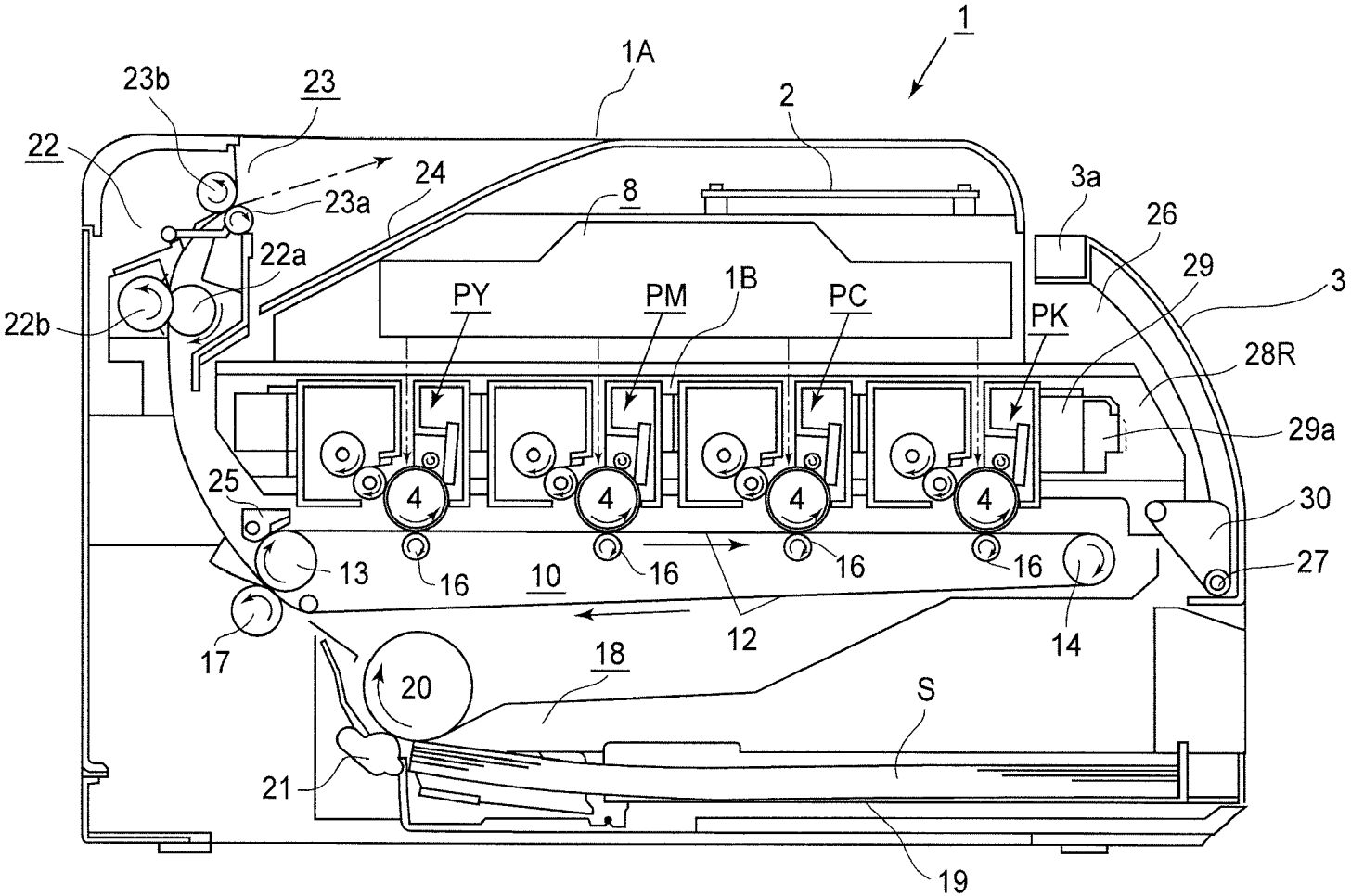
FIG. 2 is a vertical sectional view of the image forming apparatus shown in FIG. 1, as seen from the left side of the apparatus.
Figure 3:
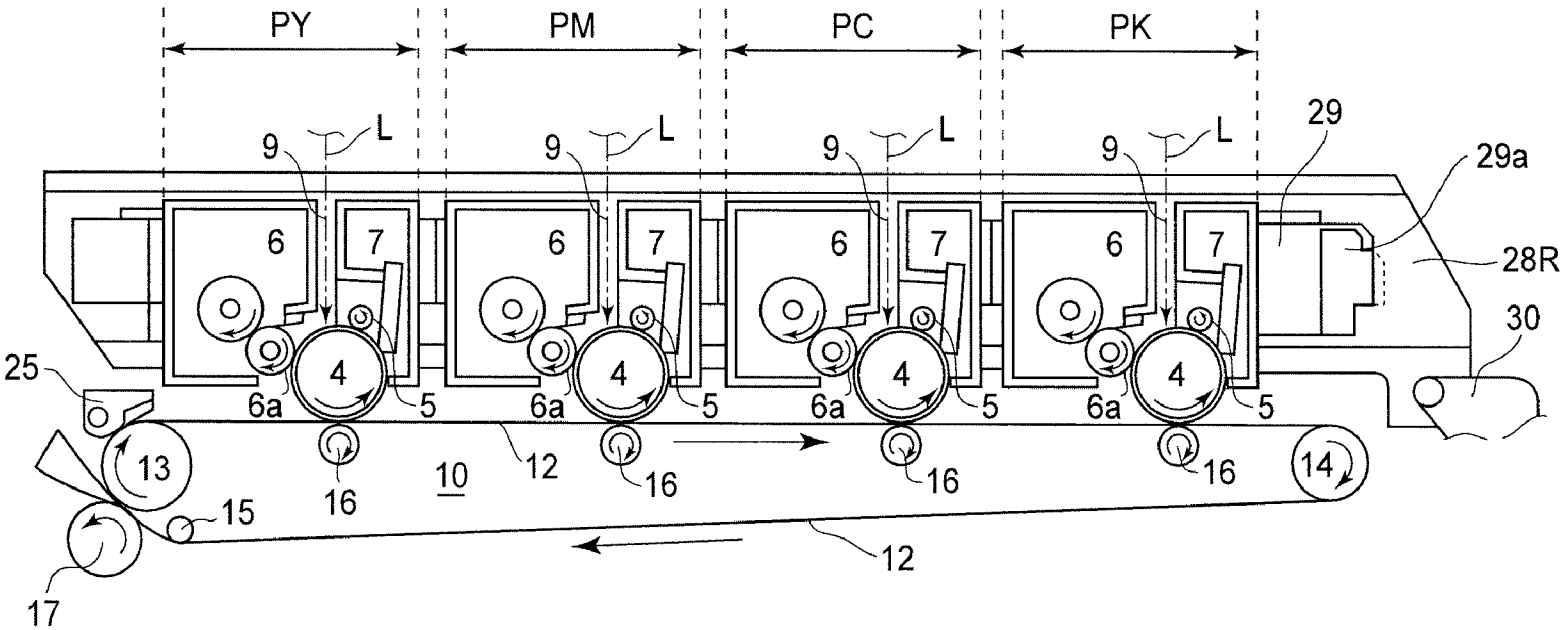
FIG. 3 is an enlargement of a part of FIG. 2.

FIG. 1 is an external perspective view of the image forming in this embodiment, and FIG. 2 is a vertical sectional view of the image forming apparatus, as seen from the left side of the apparatus. FIG. 3 is an enlargement of a part of FIG. 2.

This image forming apparatus 1 is a full-color laser printer based on four primary colors. It uses an electrophotographic process. It forms an image on a recording medium S (for example, a recording paper, an OHP sheet, a label, etc.) in response to electrical picture signals inputted from an external host apparatus (unshown), such as a personal computer, an image reader, etc.

In the following description of the preferred embodiment of the present invention, the front side (front surface side) of the image forming apparatus is the side which has a door 3. The rear side of the image forming apparatus is the side opposite to the front side. "Fore-and-after direction" includes both the frontward and rearward directions. "The left and right sides of the apparatus main assembly" means the left and right sides of the apparatus main assembly as seen from the front side of the apparatus main assembly. "Side to side direction" includes both the leftward and rightward directions.

The lengthwise end of an electrophotographic photosensitive drum (the end of a photosensitive drum in terms of a direction parallel to its axial line), from which the photosensitive drum is driven, will be referred to as the driven side, and the lengthwise end opposite thereto will be referred to as the non-driven side.

In the main assembly 1A of the image forming apparatus 1, four process cartridges (first to fourth), that is, PY, PM, PC, and PK are contained. The four cartridges PY, PM, PC, and PK are horizontally arranged in the listed order in the rear-to-front direction of the apparatus main assembly 1A (which may be referred to as inline or tandem arrangement). The four cartridges are the same in structure, although they are different in the color of the developers they store.

Each cartridge in this embodiment is an assembly which has: a drum unit 31 (first unit) made up of an electrophotographic photosensitive drum, and processing means, more specifically, a charging means 5 and a cleaning means 7, which perform processes on the drum 4; and a development unit 6 (second unit) having a developing means as a processing means. As the charging means 5, a charge roller is used. As the cleaning means 7, a cleaning blade is used. As a developing means, a development roller 6*a* is used.

The developer container of the first cartridge PY stores yellow (Y) developer. On the peripheral surface of the drum 4, a developer image of a yellow (Y) color is formed. The developer container of the second cartridge PM stores magenta (M) developer. On the peripheral surface of the drum 4, a developer image of a magenta (M) color is formed. The developer container of the third cartridge PC stores cyan (C) developer. On the peripheral surface of the drum 4, a developer image of a cyan (C) color is formed. The developer container of the fourth cartridge PK stores black (K) developer. On the peripheral surface of the drum 4, a developer image of a black (K) color is formed.

In the area above the cartridges PY, PM, PC, and PK, a laser scanner unit 8 is disposed. This scanner unit 8 exposes the peripheral surface of the drum 4 in each cartridge. That is, the picture information regarding the image to be formed by each cartridge is inputted into a control circuit 2 from the external host apparatus (unshown), and the scanner unit 8 outputs a beam of laser light L while modulating it with the picture information, so that the peripheral surface of the photosensitive drum 4 in each cartridge is scanned (exposed) by the beam of laser light L through an exposure window 9, with which the top wall of the cartridge is provided.

In the area below the cartridge PY, PM, PC, and PK, an intermediary transfer belt unit 10, as a transferring member, is disposed, which has a flexible endless belt 12 (transfer belt), a driver roller 13, a turn roller 14, and tension roller 15. The endless belt 12 is stretched around the driver roller 13, the turn roller 14, and the tension roller 15, being thereby suspended by them, so that it can be circularly driven. The driver roller 13 and tension roller 15 are disposed in the rear portion of the apparatus main assembly 1A, whereas the turn roller 14 is disposed in the front portion of the apparatus main assembly 1A. Each cartridge is disposed so that the downwardly facing portion of the peripheral surface of the drum 4 remains in contact with the upwardly facing portion of the external surface of the endless belt 12 (primary transfer nip). On the inward side of the loop, which the belt 12 forms, primary transfer rollers 16 are disposed. Each transfer roller 16 is disposed so that it opposes the drum 4 in the corresponding cartridge, with the portion of the endless belt 12, which corresponds to the top portion of the loop, pinched between the transfer roller 16 and drum 4. A secondary transfer roller 17 is disposed outside the belt loop so that it opposes the driver roller 13, with the belt 12 pinched between the two rollers.

In the area below the belt unit 10, a paper feeder unit 18 is disposed, which has a paper tray 19, a paper feeder roller 20, a paper separation pad 21, etc. The paper tray 19 is removably mountable in the apparatus main assembly 1A from the front side (front loading).

In the top portion of the rear portion of the apparatus main assembly 1A, a fixation unit 22 and a paper discharging unit 23 are disposed. Further, the top wall of the apparatus main assembly 1A is shaped so that a part of the wall is utilized as a delivery tray 24. The fixation unit 22 has a fixation film assembly 22*a* and a pressure application roller 22*b*. The paper discharging unit 23 has rollers 23*a* and 23*b*.

When each cartridge is correctly situated in its image forming position in the apparatus main assembly 1A, it remains securely held to the cartridge positioning portion of the apparatus main assembly 1A by the pressure applied from above by a cartridge pressing mechanism (which will be described later in detail), being thereby correctly positioned relative to the apparatus main assembly 1A. Further, the driving force input portion of the cartridge is engaged with the driving force output portion of the apparatus main assembly. Further, the input electrical contact of the cartridge is connected to the power supply system with which the apparatus main assembly 1A is provided.

The operation carried out by this image forming apparatus to form a full-color image is as follow: The drum 4 in each of the first to fourth cartridges PY, PM, PC, and PK is rotationally driven at a preset velocity in the counterclockwise direction indicated by an arrow mark. Further, the belt 12 is circularly driven in the clockwise direction indicated by an arrow mark (the subordinate direction with respect to the rotational direction of photosensitive drum) at a velocity which corresponds to the peripheral velocity of the drum 4. The scanner unit 8 is also driven. In synchronization with the driving of the scanner unit 8, the charge roller 5 in each cartridge uniformly charges the peripheral surface of the drum 4 to a preset polarity and potential, with a preset (controlled) timing. The scanner unit 8 scans (exposes) the peripheral surface of each drum 4 with the beam of laser light L while modulating the beam of laser light L with the picture signals for forming a monochromatic image of the primary color assigned to each cartridge. As a result, an electrostatic latent image, which reflects the picture signals corresponding to the primary color assigned to the cartridge, is formed on the peripheral surface of the drum 4. This electrostatic latent image is developed by the development unit 6 into a visible image (image formed of development).

Through the above described electrophotographic image formation process, a yellow developer image, which corresponds to the yellow color component of an intended full-color image, is formed on the drum 4 of the first cartridge PY. This yellow developer image is transferred (primary transfer) onto the belt 12.

On the drum 4 of the second cartridge PM, a magenta developer image, which corresponds to the magenta color component of the full-color image, is formed, and this developer image is transferred (primary transfer) onto the belt 12 so that it is layered on the yellow developer image which is already on the belt 12.

On the drum 4 of the third cartridge PC, a cyan developer image, which corresponds to the cyan color component of the full-color image, is formed, and this developer image is transferred (primary transfer) onto the belt 12 so that it is layered on the yellow and magenta developer images which are already on the belt 12.

On the drum 4 of the fourth cartridge PK, a black developer image, which corresponds to the black color component of the full-color image is formed, and this developer image is transferred (primary transfer) onto the belt 12 so that it is layered on the yellow, magenta, and cyan developer images which are already on the belt 12.

Consequently, an unfixed full-color developer image is formed on the belt 12 by the four monochromatic color developer images, that is, the yellow, magenta, cyan, and black color development images.

After the primary transfer of the developer image onto the belt 12, the developer remaining on the peripheral surface of the drum 4 in each cartridge is removed by the cleaning means 7.

Meanwhile, the paper feeder roller 20 is driven with the preset (controlled) timing. As the paper feeder roller 20 is driven, one of the sheets of recording medium S stacked in the paper tray 19 is separated from the rest of the sheets of recording medium S by the coordination of the sheet feeder roller 20 and separation pad 21, and is fed into the apparatus main assembly 1A by the sheet feeder roller 20. Then, the recording medium S is introduced into the nip (secondary transfer nip), that is, the interface between the secondary transfer roller 17 and the belt 12, and then, is conveyed through the nip while remaining pinched by the secondary transfer roller 17 and the belt 12. While the recording medium S is conveyed through the nip, the four layers of developer images, different in color, on the belt 12 are transferred together onto the recording medium S as if they were peeled away from the belt 12, starting at their leading edges.

The recording medium S is separated from the surface of the belt 12, and is introduced into the fixation unit 22, and is subjected to heat and pressure in the fixation nip of the fixation unit 22. As a result, the four layers of developer images different in color are fixed to the recording medium S. Thereafter, the recording medium S is moved out of the fixation unit 22, and then, is discharged as a full-color copy onto the delivery tray 24 by the paper discharging unit 23.

After the separation of the recording medium S from the belt 12, the secondary transfer residual developer, that is, the developer remaining on the surface of the belt 12 after the separation of the recording medium S from the belt 12, is removed by a belt cleaning device 25. The belt cleaning device 25 can be eliminated by utilizing the cleaning means 7. That is, the secondary transfer residual developer may be electrostatically adhered to the peripheral surface of the drum 4 in the primary transfer nip of the first cartridge PY, for example, so that it is removed from the drum 4 by the cleaning means 7.

(Method for Replacing Cartridge)

As an image forming operation is carried out by each of the first to fourth cartridges PY, PM, PC, and PK, the developer stored in the development unit 6 of each cartridge is consumed.

Thus, the image forming apparatus is provided with a means (unshown) for detecting the amount of the developer remaining in each cartridge. The detected amount of the developer in each cartridge is compared, by the control circuit portion 2, with a threshold value preset for issuing a warning, such as the cartridge is near the end of its service life, or the cartridge has reached the end of its service life. If the detected amount of the residual developer in the cartridge is smaller than the preset threshold value, the message which warns the user that the cartridge is close to the end of its life or has reached the end of its life is displayed on the screen of the monitor portion (unshown); in other words, the image forming apparatus prompts the user to prepare a replacement cartridge, or to replace the cartridge, in order to maintain a preset level of image quality.

In order to improve the image forming apparatus in usability, the image forming apparatus in this embodiment is provided with a cartridge tray (cartridge drawer: movable member which is movable while holding cartridges), which can be pulled out frontward to make it easier for a user to access the cartridges from the front side of the apparatus, in order to replace the cartridge.

When the cartridge tray is in the most outward position relative to the apparatus main assembly 1A, all the cartridges in the tray are outside the apparatus main assembly 1A, making it easier for the user to replace any cartridge in the tray.

More specifically, the front wall of the image forming apparatus 1 is provided with an opening 26, through which the cartridge can be inserted into, or removed from, the apparatus main assembly 1A. That is, the apparatus main assembly 1A has the opening 26, through which the cartridge is allowed to pass.

Further, the apparatus main assembly 1A is provided with a door 3, which can be rotationally moved between the closed position in which it covers the opening 26, and the open position in which it exposes the opening 26.

Figure 4:
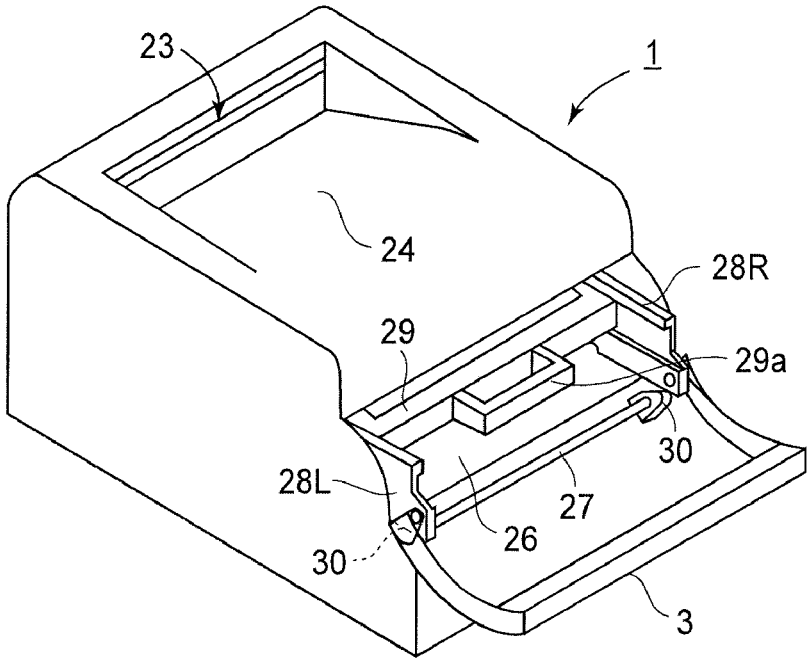
FIG. 4 is an external perspective view of the image forming apparatus, the door of which is open.
Figure 5:
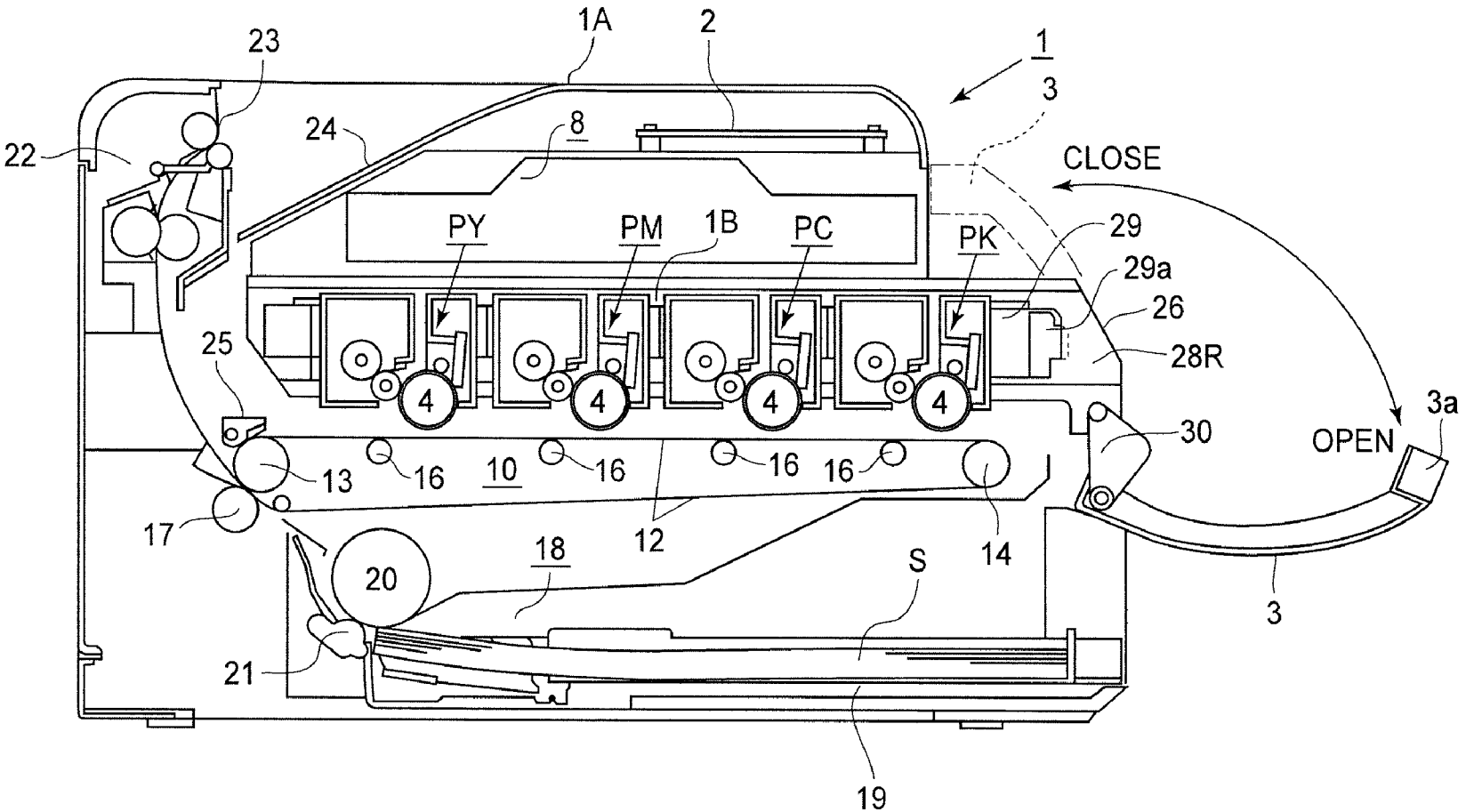
FIG. 5 is a vertical sectional view of the image forming apparatus, the door of which is open, as seen from the left side of the apparatus main assembly.

In this embodiment, this door 3 is rotationally movable relative to the apparatus main assembly 1A about a shaft 27 (door hinge shaft) located at one of the horizontal edges of the door 3. That is, the door 3 is rotatable about the hinge shaft 27 in a manner to be raised upward so that it can be moved into the closed position, in which it remains shut against the apparatus main assembly 1A, covering the opening 26, as shown in FIGS. 1 and 2, and also, so that it can be rotated frontward about the hinge shaft 27 into the open position, in a manner to be laid down, as shown in FIGS. 4 and 5, widely exposing the opening 26. Designated by reference characters 3*a* is a handle, with which the door 3 is provided. Incidentally, the opening 26 is on the front side of the apparatus main assembly 1A.

The apparatus main assembly 1A is provided with a pair of tray supporting members 28L and 28R (tray moving means) (FIG. 4), which are attached one for one to the inward side of the left and right panels of the main frame of the apparatus main assembly 1A, opposing each other. The tray 29 is supported between the pair of holding members 28L and 28R, and by the pair of holding members 28L and 28R, being enabled to horizontally slide in the fore-and-after direction of the apparatus main assembly 1A. The cartridges PY, PM, PC, and PK are supported by the tray 29.

The door 3 and the pair of holding members 28L and 28R are connected by a door linkage 30, so that as the door 3 is opened, the holding members 28L and 28R are moved both frontward and upward of the apparatus main assembly 1A, that is, slantingly upward, by preset distances, by the movement of the door 3 transmitted to the holding members 28L and 28R through the door linkage 30, while being guided by a guiding member (unshown). As a result, the holding members 28L and 28R are pulled out of the apparatus main assembly 1A through the opening 26 so that the front end portion of each holding member 28L, 28R extends outward of the apparatus main assembly 1A by a preset distance, as shown in FIGS. 4 and 5.

As the holding members 28L and 28R are moved outward, the driving force output portions (which will be described later) of the apparatus main assembly are disengaged from the corresponding driving force input portions (which will be described later) of the cartridges PY, PM, PC, and PK, respectively (disengagement of driving force transmitting means). Further, the pressure applied to each cartridge by the pressure application mechanism to secure and correctly position the cartridge is removed from the cartridge (pressure removal). Further, the tray 29 is freed from its positional restriction. Further, the electrical contacts of each cartridge are disengaged from the power supply system of the apparatus main assembly, making it thereby impossible for electric power to be supplied to the cartridge from the power supplying system on the apparatus main assembly side (electrical disengagement). Moreover, the upward movement of the holding members 28L and 28R moves upward the tray 29, which is holding the cartridges PY, PM, PC, and PK, causing the cartridges to be lifted from the corresponding cartridge positioning portions of the apparatus main assembly 1A. As a result, the downwardly facing area of the peripheral surface of the drum 4 in each cartridge is separated from the surface of the belt 12 (FIG. 5), making it possible for the tray 29 to be pulled out of the apparatus main assembly 1A.

Figure 6:
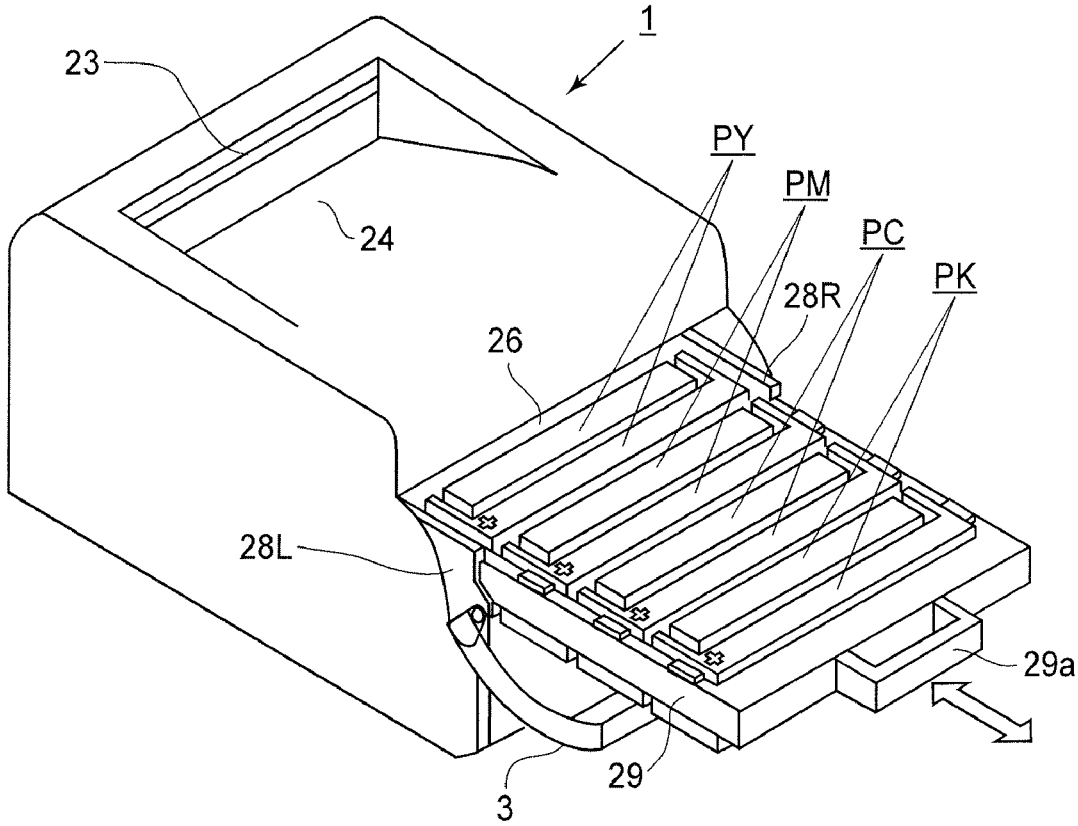
FIG. 6 is an external perspective view of the image forming apparatus, the cartridge tray of which is in its most outward position.
Figure 7:
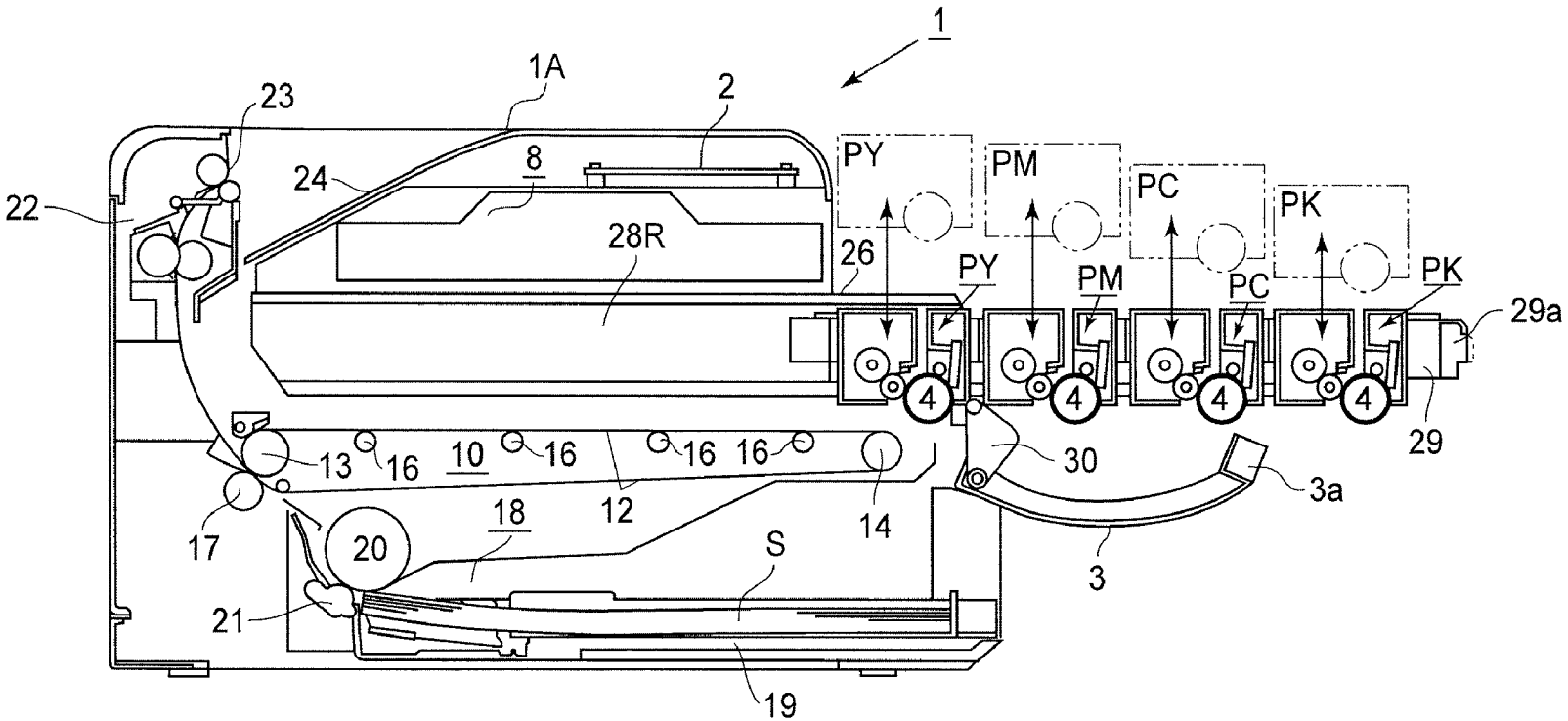
FIG. 7 is a vertical sectional view of the image forming apparatus, the cartridge tray of which is in its most outward position, as seen from the left side of the apparatus.

At this point, the user is to grasp the handle 29*a* exposed through the opening 26, and pull the tray 29 in the horizontal and frontward direction to slide the tray 29 relative to the pair of holding members 28L and 28R so that the tray 29 comes out of the apparatus main assembly 1A through the opening 26, and moves into its preset most outward position shown in FIGS. 6 and 7.

As the tray 29 is pulled out to the abovementioned preset position, the first-fourth cartridges PY, PM, PC, and PK held in the tray 29 are all moved out of the apparatus main assembly 1A through the opening 26, being exposed from the apparatus main assembly 1A; the top surface of each cartridge is exposed. The apparatus main assembly 1A is structured so that as the tray 29 is pulled out by a preset distance which is sufficient to expose all the cartridges, it is prevented by a pair of stoppers (unshown) from being pulled out further, and also, so that once the tray 29 is pulled out to the preset most outward position, it is securely retained in this most outward position by the holding members 28L and 28R.

This structure makes it unnecessary for the belt 12 to be moved in order for a user to replace the cartridge from the front side of the apparatus main assembly 1A.

The tray 29 is structured to loosely hold each cartridge so that each cartridge can be moved out straight upward from the tray 29, and also, so that the replacement cartridge for each of the first to fourth cartridges can be mounted into the tray 29 from directly above. Thus, the user is to extract from the tray 29 the cartridge or cartridges, which are to be replaced, that is, the cartridge or cartridges, the life of which has expired, by simply lifting it, and then, fit a brand-new cartridge or cartridges, from directly above, into the vacated space or spaces, one for one, in the tray 29, as indicated by a double-dot chain line in FIG. 7.

In this embodiment, the tray 29 holds the cartridges PK, PC, PM, and PY, in which the developers of K, C, M, and Y colors, respectively, are stored. The order in which the cartridges PK, PC, PM, and PY are arranged in the tray 29 is the same as they are listed above. Namely, in terms of the upstream to downstream direction, that is, the direction in which the tray 29 is moved into the apparatus main assembly 1A from outside of the apparatus main assembly 1A, the cartridges PK, PC, PM, and PY are arranged in the listed order. In other words, in this embodiment, the cartridges are arranged according to the amount of developer consumption, so that the cartridge highest in developer consumption, that is, the cartridge highest in replacement frequency, is placed closest to the side from which the user operates the image forming apparatus. Therefore, the distance by which the tray 29 must be pulled out of the apparatus main assembly to expose the cartridge PK is very small. Thus, the image forming apparatus 1 in this embodiment is superior in operability to an image forming apparatus in accordance with the prior art, in terms of the efficiency with which the cartridge PK can be replaced.

After the user replaces the cartridge or cartridges in the tray 29 with a brand-new cartridge or cartridges, the user is to perform in reverse the above described sequence for placing a cartridge in the tray 29 or replacing the cartridge in the tray 29. That is, the user is to horizontally slide the tray 29, which is in its most outward position at this point in time, relative to the holding members 28L and 28R, in the rearward direction of the apparatus main assembly 1A so that the tray 29 is moved back into the apparatus main assembly 1A through the opening 26. The tray 29 is to be pushed back into the apparatus main assembly 1A to the point at which the stopper portion prevents the tray 29 from being pushed further back into the apparatus main assembly 1A; in other words, the tray 29 is returned into the position shown in FIGS. 4 and 5.

Then, the user is to rotate the door 3 in the direction to close the door 3. As the door 3 is operated in the direction to be closed as described, the door linkage 30 is moved by the movement of the door 3, and the holding members 28L and 28R are moved by the door linkage 30, in both the inward and downward direction, that is, slantingly downward direction, of the apparatus main assembly 1A, while being guided by the guiding member (unshown). As the holding means 28L and 28R are moved, the movement of the holding means 28L and 28R causes the cartridge pressing mechanism to press each cartridge. As a result, each cartridge is pressed against the corresponding cartridge positioning portion of the apparatus main assembly 1A, being thereby securely and correctly positioned relative to the apparatus main assembly 1A. Further, the driving force input portion of each of the cartridges PY, PM, PC, and PK is connected with the corresponding driving force output portion of the apparatus main assembly, and the input electrical contacts of the cartridge are connected to the power supply system of the apparatus main assembly, enabling the cartridges to be supplied with the power from the power supply system of the apparatus main assembly 1A. Further, the tray 29 is securely and correctly positioned relative to the apparatus main assembly 1A, and the downwardly facing area of the peripheral surface of the drum 4 in each cartridge is placed in contact with the surface of the belt 12. That is, the state of the image forming apparatus, shown in FIGS. 1 and 2, in which each of the cartridges PY, PM, PC, and PK is in its preset image formation position in the apparatus main assembly 1A, is restored. In other words, the image forming apparatus 1 is readied for an image forming operation.

The tray 29 is a drawer movable in a straight line in the practically horizontal direction, which is perpendicular to the lengthwise direction of the drum 4, while holding multiple cartridges. The tray 29 can be moved into or out of the apparatus main assembly 1A; the tray 29 is enabled to take the most inward position, that is, the image forming position, relative to the apparatus main assembly 1A, and the most outward position, relative to the apparatus main assembly 1A, in which it allows the cartridges to be mounted into, or dismounted from, the tray 29.

The holding members 28L and 28R also function as a cartridge moving means, which moves the tray 29 upward from the abovementioned latent image formation position before it moves the tray 29 into the abovementioned most outward position, in which the tray 29 allows the cartridges to be mounted or dismounted, or moves the tray 29 downward into the latent image formation position. In other words, the holding members 28L and 28R are members for supporting the tray 29, and are enabled to take the first position, in which they allow the tray 29 to be moved between the abovementioned most outward position and transitional position, and the second position, in which they retain the tray 29 in the abovementioned latent image formation position. As the door 3 is closed, the holding members 28L and 28R are moved from the first position to the second position by the movement of the door 3. Further, as the door 3 is opened, the holding members 28L and 28R are moved from the second position to the first position by the movement of the door 3.

<Cartridge>

The first to fourth cartridges PY, PM, PC, and PK in this embodiment are the same in structure. Next, referring to FIGS. 8-10, the cartridge structure in this embodiment will be described.

Figure 8:
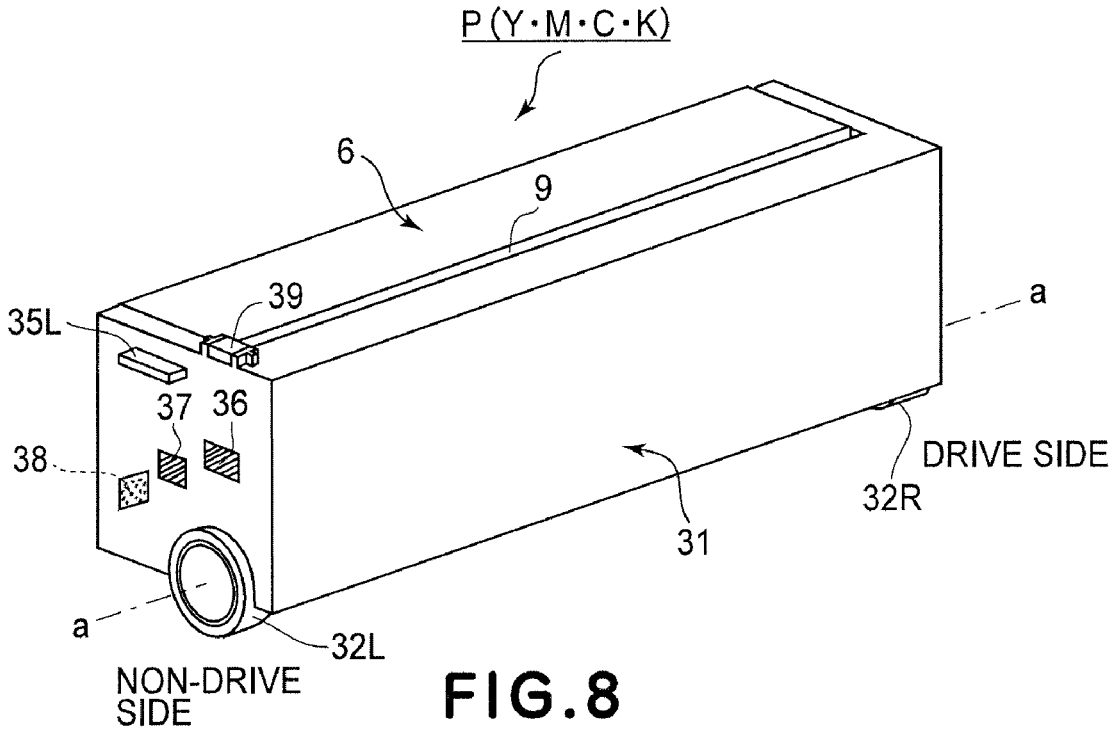
FIG. 8 is an external perspective view of the cartridge, as seen from the side from which the cartridge is not driven.
Figure 9:
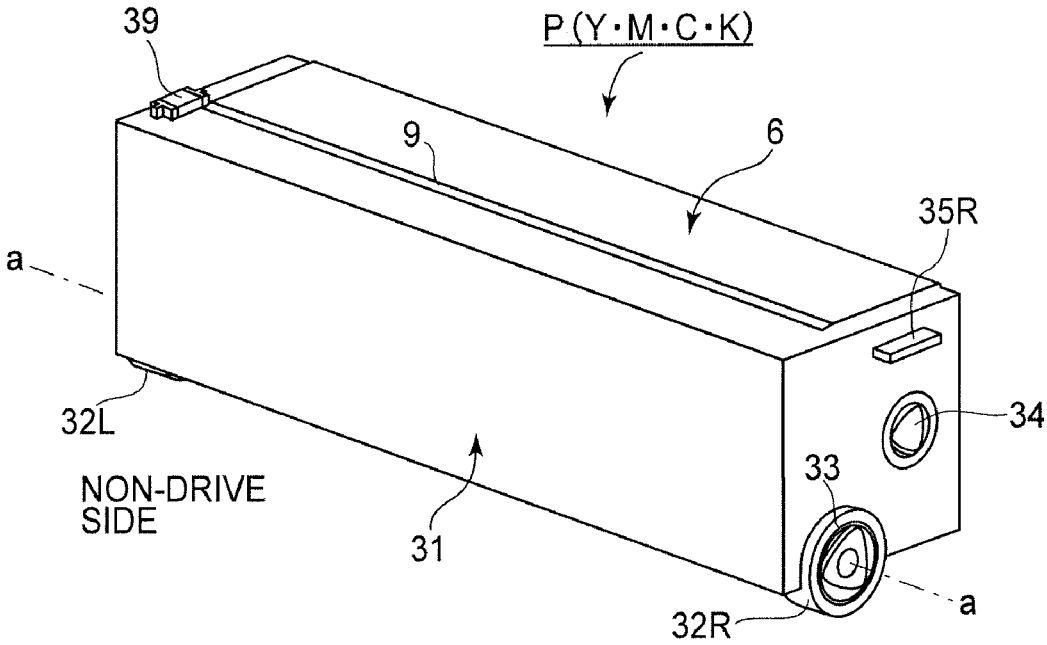
FIG. 9 is an external perspective view of the cartridge, as seen from the side from which the cartridge is driven.
Figure 10:
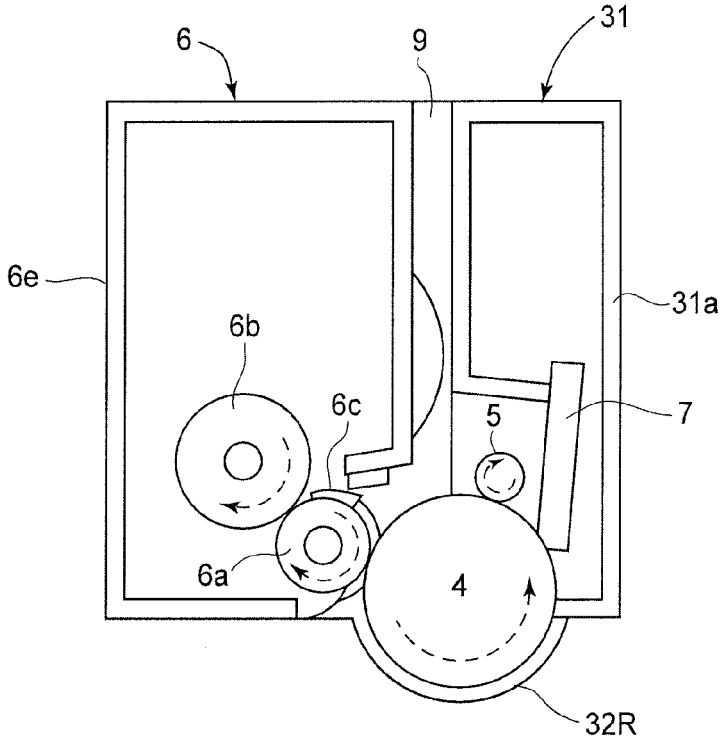
FIG. 10 is a cross-sectional view of the cartridge, as seen from the lengthwise end on the left side.

FIG. 8 is a perspective view of the cartridge, as seen from the aforementioned non-driven side, and FIG. 9 is a perspective view of the cartridge, as seen from the aforementioned driven side. FIG. 10 is a cross-sectional view of the cartridge, as seen from the right side of the cartridge.

The leftward or rightward direction of each cartridge is the direction parallel to the axial line a-a of the drum 4. The cartridge is an assembly, the lengthwise direction of which is the same as its leftward or rightward direction.

Referring to FIG. 10, the drum unit 31 has a cleaning means container 31*a* (cleaning means housing), in which the drum 4, the charge roller 5, and the cleaning blade 7 are disposed. The drum 4 is rotatably held by, and between, the left and right panels of the container 31*a*, with bearings 32L and 32R (portions-to-be-positioned or portions-to-be-supported) placed between the drum 4 and the panels. The charge roller 5 is placed in contact with, and in parallel to, the drum 4, and is rotatably attached to, and between, the left and right panels, with bearings placed between the charge roller 5 and the left and right panels. The blade 7 is formed of elastic rubber. The blade 7 is fixed to the container 31*a* by its base portion, in contact with the drum 4, being tilted in the direction to counter the rotational direction of the drum 4. The blade 7 plays the role of removing the developer remaining on the drum 4. The developer removed from the peripheral surface of the drum 4 by the blade 7 is stored in the container 31*a*.

The development unit 6 is provided with a developing means container 6*e* (developing means housing). It also has a development roller 6*a*, and a developer coating roller 6*b*, and a developer regulating member 6*c* (development blade), which are disposed in the container 6*e*. The developer (unshown) is stored in the container 6*e*. The development roller 6*a* is a roller formed of elastic rubber. It is located between the left and right panels of the container 6*e*, and is rotatably supported by the left and right panels, with bearings placed between the development roller 6*a* and left and right panels. The developer supply roller 6*b* is a roller for coating the development roller 6*a* with developer. It is disposed, in contact with the development roller 6*a*, between the left and right panels of the container 6*e*, and is rotatably supported by the left and right panels, with bearings placed between the development supply roller 6*b*, and left and right panels. The developer regulating member 6*c* is a piece of thin elastic plate, and is fixed to the container 6*e* by one of its edge portions. It is placed in contact with the development roller 6*a*. It is on the downstream side of the developer supply roller 6*b*, in terms of the rotational direction of the development roller 6*a*, and is tilted in the direction to counter the rotational direction of the development roller 6*a*. The regulating member 6*c* regulates in thickness the body of developer coated on the development roller 6*a* by the supply roller 6*b*; it forms a developer layer with a preset thickness, on the development roller 6*a*. It also plays the role of giving a preset amount of electrical charge to the developer while the developer is coated on the development roller 6*a*.

Each cartridge is provided with a drum driving coupling 33 (drum driving force receiving portion), a development roller driving coupling 34 (developer roller driving force receiving portion), and a cartridge holding portion 35R, which are located at one of the lengthwise ends of the cartridge, that is, the lengthwise end on the driven side. The cartridge holding portion 35R is located close to the top edge of the cartridge. The axial line of the drum driving coupling 33 coincides with that of the drum 4. When the cartridge is in the preset image formation position in the apparatus main assembly, the drum driving coupling 33 receives from the apparatus main assembly the force for driving the drum 4, whereas the development roller driving coupling 34 receives from the apparatus main assembly 1A the force for driving the development roller 6*a*. The cartridge holding portion 35R is the portion by which the cartridge is held by the tray 29, and is located close to the top edge of the cartridge. Further, as the cartridge is mounted into the apparatus main assembly 1A, the bearing 32R, that is, the bearing on the driven side, engages with the cartridge positioning portion of the apparatus main assembly, on the driven side; in other words, the bearing 32R plays the role of a portion which is to be supported by the apparatus main assembly to correctly position the driven end of the cartridge relative to the apparatus main assembly 1A. The bearing 32R is located at the bottom end of the cartridge.

The lengthwise end of the cartridge, on the non-driven side, is provided with the cartridge supporting portion 35L. The cartridge supporting portion 35L is the portion by which the non-driven end of the cartridge is supported by the tray 29 as the driven end of the cartridge is supported by the cartridge supporting portion on the driven side. It is located close to the top edge of the cartridge. As the cartridge is mounted into the apparatus main assembly 1A, the bearing 32L, that is, the bearing on the non-driven side, engages with the cartridge positioning portion of the apparatus main assembly, on the non-driven side; in other words, the bearing 32L plays the role of a portion which is to be supported by the apparatus main assembly to correctly position the non-driven end of the cartridge relative to the apparatus main assembly 1A. The bearing 32L is located at the bottom end of the cartridge.

As the cartridge is moved into its preset image forming position in the apparatus main assembly 1A, the drum driving couplings 33 and development roller driving coupling 34 are engaged with the first and second driving force output portions (unshown) of the apparatus main assembly, respectively; when the cartridge is in its preset image formation position, the couplings 33 and 34 are in engagement with the first and second driving force output portions. As driving force is transmitted from the first driving force output portion to the drum driving coupling 33, the drum 4 is rotationally driven by the transmitted driving force in the counterclockwise direction (FIG. 10) at a preset peripheral velocity. The charge roller 5 is rotated by the rotation of the drum 4.

It is from the second driving force output portion that driving force is transmitted to the development roller driving coupling 34. The development roller driving coupling 34 is provided with a stepped gear (unshown), which is a part of the rotational axle of the development roller 6*a*, and is integrally formed with the rotational axis. The stepped gear is directly in mesh with the development roller 6*a*, and a gear (unshown) for driving the developer coating roller 6*b*. Thus, in order to rotate the development roller 6*a* and developer coating roller 6*b* in the clockwise direction of FIG. 10, a rotational driving force is inputted into the development roller driving coupling 34 from the second driving force output portion of the apparatus main assembly 1A in the direction to rotate the coupling 34 in the counterclockwise direction of FIG. 10.

The developer in the container 6*e* is coated on the development roller 6*a*, which is being rotationally driven, by the rotating supply roller 6*b*, which is being rotationally driven. The body of developer coated on the development roller 6*a* is regulated in thickness by the developer regulating member 6*c*, forming a developer layer with a preset thickness, on the development roller 6*a*, while being give an electrical charge. Then, the developer on the development roller 6*a* is conveyed by the rotation of the development roller 6*a* to a development area, that is, the contact area between the development roller 6*a* and the drum 4, in which the developer is used for developing the latent image on the drum 4. The developer remaining on the peripheral surface of the development roller 6*a* after the development of the latent image is returned by the rotation of the development roller 6*a* to the container 6*e*, in which the developer is removed by the supply roller 6*b* from the peripheral surface of the development roller 6*a* at the same time as the peripheral surface of the development roller 6*a* is coated with a fresh supply of developer, that is, the developer in the container 6*e*, by the supply roller 6*b*.

Each cartridge is provided with first to fourth electrical contacts 36-39 (cartridge electrical contacts), which are located at the left end, that is, the non-driven end, of the cartridge. The first electrical contact 36 is electrically in contact with the charge roller 5, and receives from the apparatus main assembly 1A the charge bias which is supplied to the charge roller. The second electrical contact 37 is electrically in contact with the development roller 6*a*, and receives from the apparatus main assembly 1A the development bias which is supplied to the development roller 6*a*. The third electrical contact 38 is electrically in connection with the developer coating roller 6*b*, and receives from the apparatus main assembly 1A the developer coating bias which is supplied to the developer coating roller 6*b*. The fourth electrical contact 39 is an electrical contact having a memory chip. It is electrically connected to the control portion 2 of the apparatus main assembly 1A, being thereby enabled to communicate with the control portion 2.

The first and second electrical contacts 36 and 37 are exposed at the outward surface of the left end wall of the cartridge. The third electrical contact 38 is exposed at the front surface of the cartridge, in terms of the direction in which the tray 29 is moved into the apparatus main assembly. The fourth electrical contact 38 is exposed at the top surface of the cartridge.

<Cartridge Tray>

Figure 11:
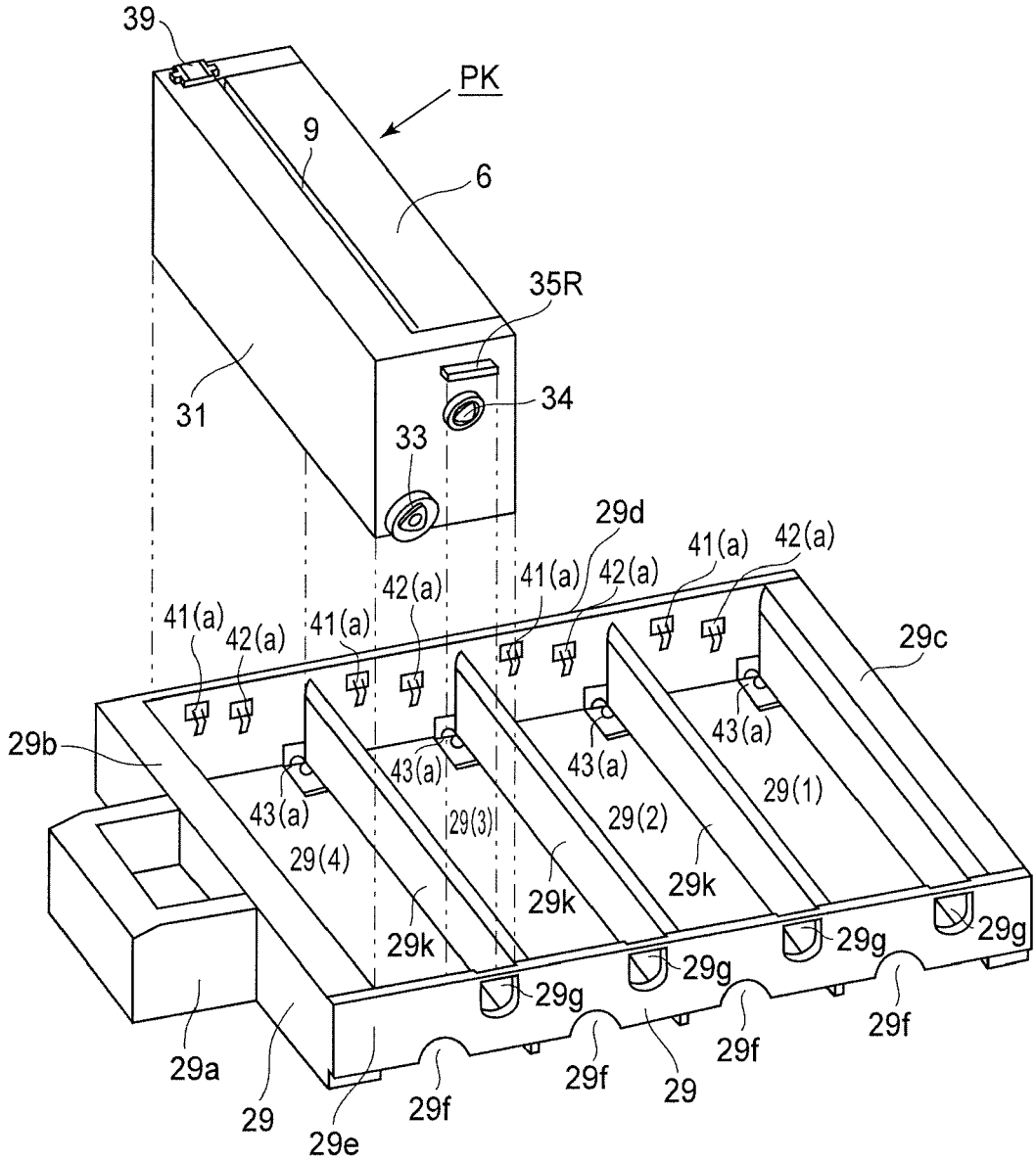
FIG. 11 is an external perspective view of the cartridge tray, as seen from the side from which the cartridge is driven.
Figure 12:
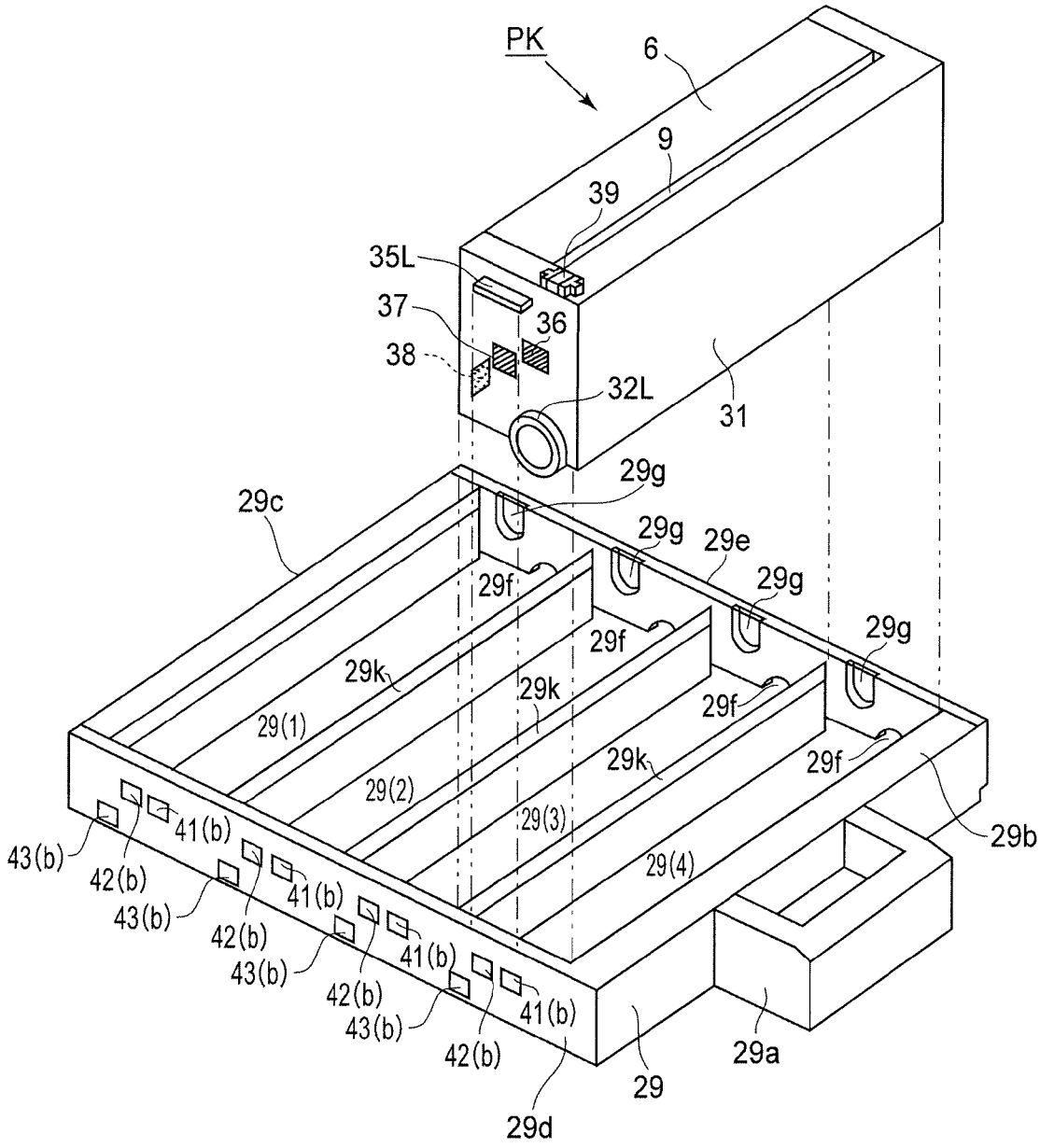
FIG. 12 is an external perspective view of the cartridge tray, as seen from the side from which the cartridge is not driven.

Next, referring to FIGS. 11 and 12, the tray 29 will be described. The tray 29 has a rectangular main frame, which is made up of four sections 29*b*, 29*c*, 29*d*, and 29*e*, that is, front, rear, left, and right sections, which are joined at their lengthwise ends. The space within the rectangular main frame is partitioned into four rectangular sub-spaces of roughly the same size by three partition plates 29*k*. The four sub-spaces are arranged in the fore-and-after direction, and their long edges are parallel to the side-to-side direction of the apparatus main assembly 1A. Hereafter, these four sub-spaces will be referred to as first-fourth cartridge compartments 29(1)-29(4), listing from the rear section 29*c* side toward the front section 29*b*. These cartridge compartments 29(1)-29(4) of the tray 29 are the compartments into which the first to fourth cartridges PY, PM, PC, and PK are inserted to be held therein one for one (cartridge storage space; cartridge slot). The tray 29 loosely holds the cartridges PY, PM, PC, and PK, in its four cartridge compartments 29(*a*)-29(4), the long edges of which are parallel to the side-to-side direction of the apparatus main assembly 1A.

The lengthwise end wall of each of the cartridge compartments 29(1)-29(4), which corresponds to the right section 29*e* (driven side) of the main frame of the tray 29, is provided with holes 29*f* and 29*g*, through which the first and second driving force output portions of the apparatus main assembly move into, or out of, the cartridge compartment (tray 29). The lengthwise end wall of each cartridge compartment, which corresponds to the left section 29*d* (non-driven side) of the main frame of the tray 29, is provided with first to third intermediary electrical contacts 41-43, which will become connected to the first to third electrical contacts 36-38 of the cartridge. The intermediary electrical contacts 36-38 are formed of an elastic (springy) substance.

Each of the intermediary electrical contacts 41-43 has an inward portion (a), which is exposed on the inward side of the corresponding cartridge compartment of the tray 29, and an outward portion (b), which is exposed on the outward side of the corresponding cartridge compartment of the tray 29. The inward portion (a) and outward portion (b) are electrically connected to each other. The inward portions (a) of the intermediary electrical contacts 41-43 are electrically connectible with the first to third input electrical contacts 36-38 of the cartridge, respectively. Further, the outward portions (b) of the intermediary electrical contacts 43-45 are electrically connectible with the output electrical contacts of the bias application circuit of the apparatus main assembly 1A (main assembly electrical contacts (unshown)), one for one.

As for the method for inserting the cartridges PY, PM, PC, and PK into the cartridge compartments 29(1)-29(4), respectively, the cartridges may be released into the cartridge compartments from above. As the cartridges are released, the cartridge supporting portions 35R and 35L of each cartridge, which are on the driven and non-driven sides, respectively, are caught by the top surfaces of the right and left sections 29*e* and 29*d* of the tray frame; the bottom surfaces of the cartridge supporting portions 35R and 35L come into contact with the top surfaces of the right and left sections 29*e* and 29*d*. As a result, the cartridge rests on the tray 29; the cartridge is supported by the tray 29. That is, at this point, the tray 29 is supporting the cartridge so that the cartridge can be removed from the tray 29 by simply lifting the cartridge straight upward; the cartridge is supported by the tray 29 by being simply lowered into the tray 29 from straight above. Further, as the cartridge is lowered into the tray 29, the first to third input electrical contacts 36-38 of the cartridge come into contact, and remain elastically in contact, with the inward portions (a) of the intermediary electrical contacts 41-43 of the tray 29, respectively, establishing thereby an electrical connection between the cartridge and tray 29. As the tray 29 is moved into the apparatus main assembly 1A, the movement of the tray 29 moves each cartridge into the preset latent image forming position of the cartridge, in the apparatus main assembly 1A, and the outward portions (b) of the intermediary electrical contacts 41-43 of the tray 29 come into contact with the output electrical contacts of the bias application circuit of the apparatus main assembly 1A, establishing an electrical connection between the tray 29 and apparatus main assembly 1A. As a result, the first to third input electrical contacts 36-38 of the cartridge become electrically connected to the power supply system of the apparatus main assembly 1A through the intermediary electrical contacts 41-43 of the tray 29. The intermediary electrical contacts 41-43 play the role of supplying the cartridge with the electrical biases that they receive from the output electrical contacts of the apparatus main assembly 1A.

In the above described embodiment, the electrical contacts and the like are attached to the lengthwise end of the cartridge, on the non-driven side, and the lengthwise end of the tray 29, on the non-driven side. However, this embodiment is not intended to limit the present invention in scope. That is, they may be attached to the lengthwise end of the cartridge, and the lengthwise end of the tray 29, on the driven side.

<Correct and Firm Positioning of Cartridge>

Figure 13:
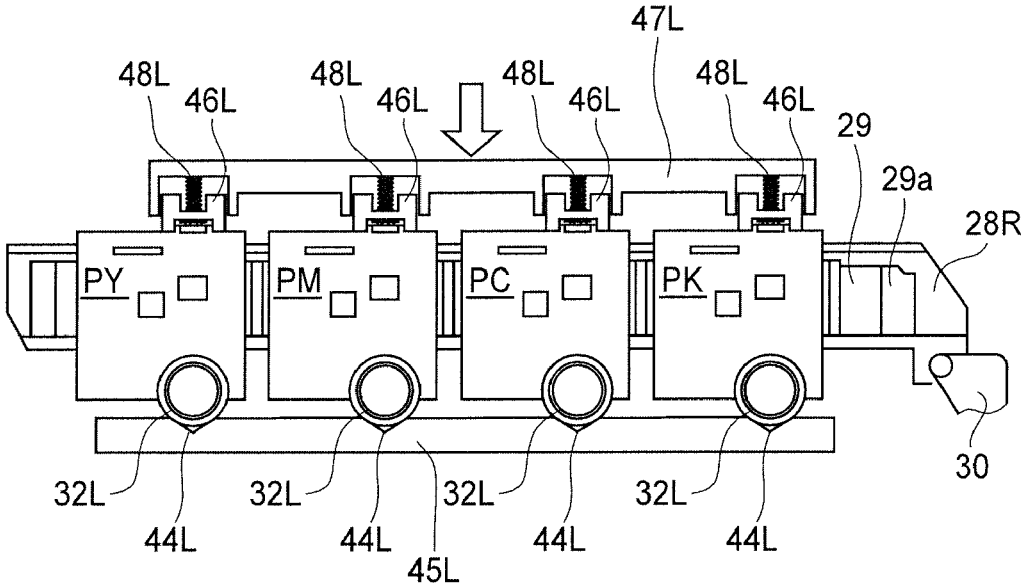
FIG. 13 is a side view of the cartridges, cartridge tray, cartridge pressing members and cartridge pressing member holding member of the apparatus main assembly, and cartridge positioning member of the apparatus main assembly, as seen from the side from which the cartridges are not driven, in which the cartridges are firmly held in the correct positions in the tray, on the non-driven side.
Figure 14:
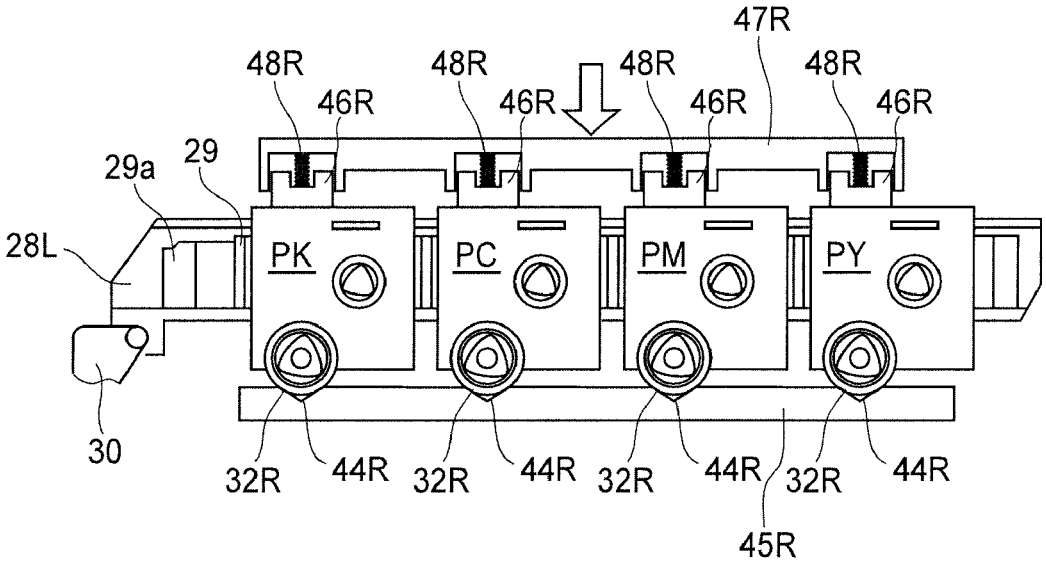
FIG. 14 is a side view of the cartridges, the cartridge tray, the cartridge pressing members and the cartridge pressing member holding member of the apparatus main assembly, and cartridge positioning member of the apparatus main assembly, as seen from the side from which the cartridges are driven, in which the cartridges are firmly held in the correct positions in the tray, on the driven side.

FIG. 13 is a side view of the cartridges correctly positioned in the tray, as seen from the side from which the cartridges are not driven, showing how the cartridges are firmly held in the correct positions in the tray, on the non-driven side. FIG. 14 is a side view of the cartridges correctly positioned in the tray, as seen from the side from which the cartridges are driven, showing how the cartridges are firmly held in the correct positions in the tray.

As each cartridge is moved into the apparatus main assembly 1A while being held in the tray 29, the cartridge holding portions 32L and 32R, that is, cartridge holding portions on the non-driven and driven sides, respectively, of the cartridge engage with the cartridge positioning portions 44L and 44R, that is, cartridge positioning portions on the non-driven and driven sides, respectively, of the apparatus main assembly 1A. As a result, the apparatus main assembly 1A supports the cartridge by the cartridge holding portions 32L and 32R from under the cartridge. That is, the cartridge is supported in the apparatus main assembly, at a minimum of two points in terms of the lengthwise direction of the drum 4.

In this embodiment, the cartridge positioning portions 44L and 44R, that is, the cartridge positioning portions on the non-driven and driven sides, are grooves with which the left and right stays 45L and 45R are provided, respectively. The left and right stays 45L and 45R are solidly fixed to the inward sides of the left and right panels of the apparatus main assembly 1A, and extend in the fore-and-after direction of the apparatus main assembly 1A. The cartridge positioning portions 44L and 44R, or the left and right grooves of the stays 45L and 45R, are V-shaped in cross-section, and extend in the fore-and-after direction of the apparatus main assembly 1A. As the downwardly arcuate portion of each of the left and right cartridge supporting portions 32L and 32R of the cartridge fit into these grooves, one for one, the cartridge is correctly positioned relative to the apparatus main assembly 1A. More specifically, the cartridge supporting portions 32L and 32R of the cartridge are in the form of a segment of a circle, and the centers of their arcs coincide with the axial line of the drum 4. Thus, as the cartridge is moved into the apparatus main assembly 1A, the arcuate surface of each cartridge supporting portion 32 comes into contact with the inward surface (opposing two surfaces) of the corresponding cartridge positioning groove 44 of the apparatus main assembly 1A, at two locations.

Further, as each cartridge is moved into the apparatus main assembly 1A, the non-driven and driven ends of the top surface of the cartridge are pressed downward by the cartridge pressing members 46L and 46R, that is, the cartridge pressing members on the non-driven and driven sides, respectively, of the apparatus main assembly 1A, causing the cartridge supporting portions 32L and 32R, on the non-driven and driven sides, respectively, to be pressed upon the cartridge positioning portions 44L and 44R, on the non-driven and driven sides, respectively, of the apparatus main assembly 1A. As a result, not only is the cartridge correctly positioned relative to the apparatus main assembly 1A, but also, is firmly held to the apparatus main assembly 1A.

The apparatus main assembly 1A is provided with four pairs of cartridge pressing members 46L and 46R, that is, a pair for each cartridge, and a pair of cartridge pressing member holding members 47L and 47R, which are on the non-driven and driven sides, respectively. The cartridge pressing members 46L are held to the under side of the cartridge pressing member holding member 47L, being aligned in the lengthwise direction of the member 47L. More specifically, each cartridge pressing member 46L is held to the cartridge pressing member holding member 47L, with an elastic member 48L (compression coil spring) placed between the cartridge pressing member holding member 47L and cartridge pressing member 46L so that the cartridge pressing member 46L vertically slides relative to the apparatus main assembly 1A.

The cartridge pressing members 46R are held to the under side of the cartridge pressing member holding member 47R, being aligned in the lengthwise direction of the member 47R. More specifically, each cartridge pressing member 46R is held to the cartridge pressing member holding member 47R with an elastic member 48R (compression coil spring) placed between the cartridge pressing member holding member 47R and cartridge pressing member 46R so that the cartridge pressing member 46R vertically slides relative to the apparatus main assembly 1A.

The abovementioned cartridge pressing member holding members 47L and 47R, on the non-driven and driven sides, respectively, are vertically moved in parallel to each other by the opening or closing movement of the door 3 (that is, movement of door linkage 30) (drawing does not show door linkage). More specifically, as the door 3 is moved in the direction to be completely shut against the apparatus main assembly 1A, the cartridge pressing member holding members 47L and 47R are pushed down by the movement of the door 3 through the door linkage 30, causing the bottom surfaces of the cartridge pressing members 46L and 46R of the apparatus main assembly 1A to come into contact with the top surface of the corresponding cartridge. Then, the elastic members 48L and 48R are compressed between the cartridge pressing member holding members 47L and 47R and the cartridge pressing members 46L and 46R of the apparatus main assembly 1A by the subsequent downward movement of the cartridge pressing member holding members 47L and 47R. Consequently, the portions of the top surface of the cartridge, which are in contact with the cartridge pressing members 46L and 46R of the apparatus main assembly 1A, are pressed by the reactive force generated by the compression of the elastic members 48L and 48R. As a result, the cartridge supporting portions 32L and 32R of the cartridge, on the non-driven and driven sides, respectively, are pressed on the cartridge positioning portions 44L and 44R of the apparatus main assembly 1A, on the non-driven and driven sides, respectively, correctly and securely positioning the cartridge relative to the apparatus main assembly 1A.

Figure 15:
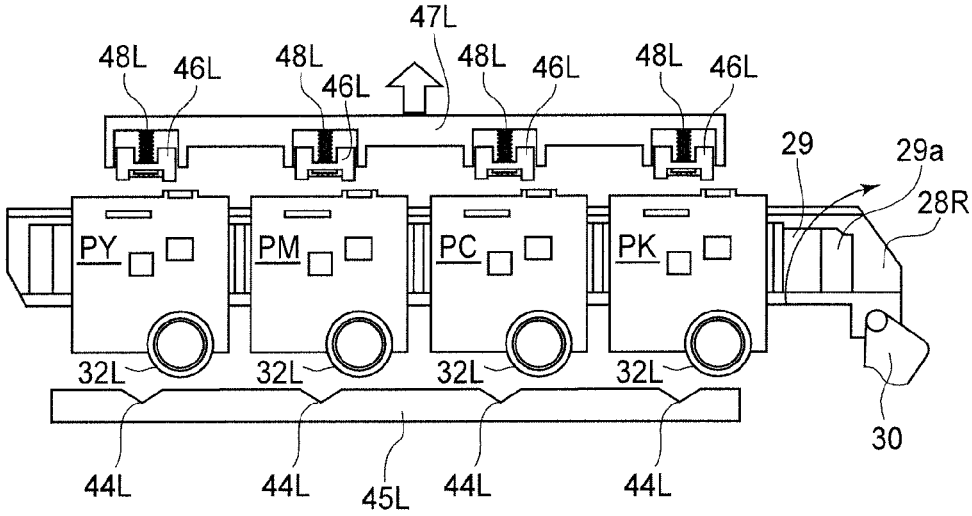
FIG. 15 is a side view of the cartridges, the cartridge tray, the cartridge pressing members and the cartridge pressing member holding member of the apparatus main assembly, and the cartridge positioning member of the apparatus main assembly, as seen from the side from which the cartridges are not driven, in which the cartridges are free from the cartridge pressing members and cartridge positioning member of the apparatus main assembly.
Figure 16:
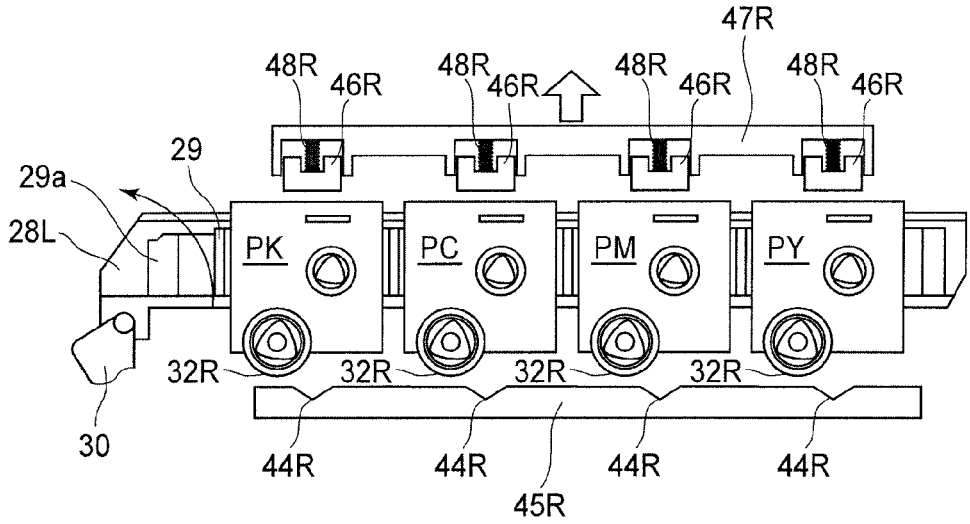
FIG. 16 is a side view of the cartridges, the cartridge tray, the cartridge pressing members and the cartridge pressing member holding member of the apparatus main assembly, and the cartridge positioning member of the apparatus main assembly, as seen from the side from which the cartridges are driven, in which the cartridges are free from the cartridge pressing members and cartridge positioning member of the apparatus main assembly.

As the door 3 is opened, the cartridge pressing member holding members 47L and 47R move upward in parallel to each other, separating thereby the cartridge pressing members 46L and 46R of the apparatus main assembly 1A from the cartridge as shown in FIGS. 15 and 16; the pressure applied on the cartridge by the cartridge pressing members 46L and 46R is removed.

<Relationship between Fourth Electrical Contact 39 of Cartridge and Cartridge Pressing Member 46L of Apparatus Main Assembly>

Figure 17:
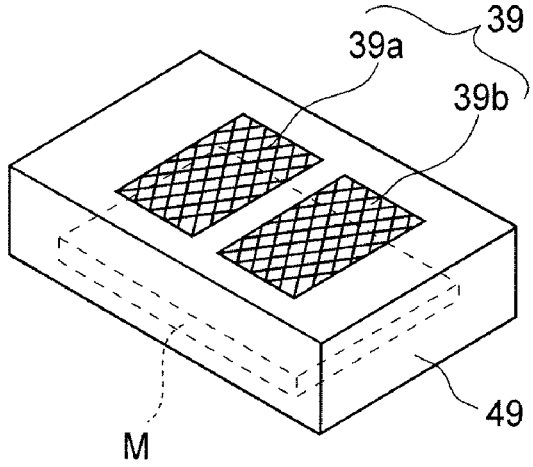
FIG. 17 is a perspective view of the substrate of the memory chip of the cartridge, which has the fourth electrical contact of the cartridge.

In this embodiment, the abovementioned fourth electrical contact 39 (FIG. 8) of each cartridge, that is, the electrical contact located at the top surface of the lengthwise end on the non-driven side, is the electrical contact for the memory chip. More specifically, referring to FIG. 17, the electrical contact 39 is made up of a pair of contact points 39*a* and 39*b*, which are exposed at one of the primary surfaces of the substrate 49 of the memory chip. The memory M is on the opposite surface of the substrate 49 from the contact points 39*a* and 39*b*. The electrical contacts 39*a* and 39*b* are electrically in connection with the memory M.

Figure 18:
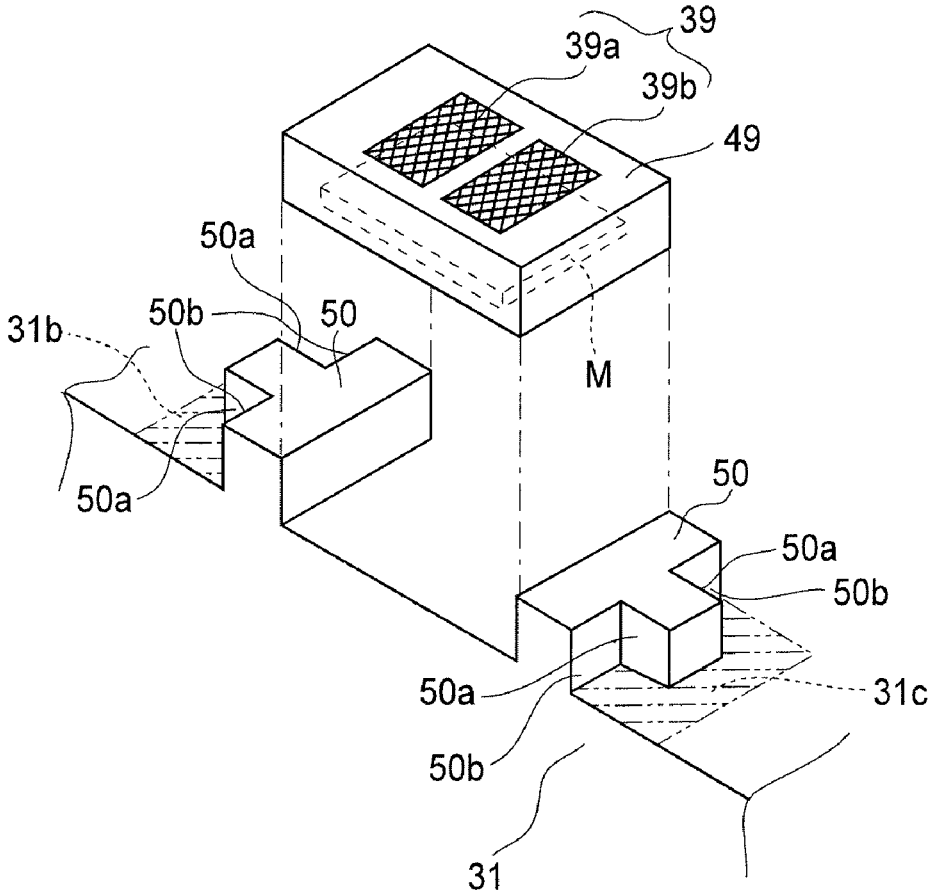
FIG. 18 is an exploded view of the protrusions of the cartridge, and the substrate which has the fourth electrical contact of the cartridge.

Referring to FIG. 18, the drum unit 31 (first frame) is provided with a pair of protrusions 50 and 50, which are on the non-driven side of the top surface of the drum unit 31. The protrusions 50 and 50 are aligned in the direction perpendicular to the axial line of the drum 4, with the provision of a gap which corresponds to the length of the abovementioned substrate 49. The substrate 49 is fitted between the protrusions 50 and 50 so that its top surface, that is, the surface having the electrical contact points 39*a* and 39*b*, faces upward, and also so that its lengthwise direction is parallel to the axial line of the drum 4. The substrate is glued to the top surface of the drum unit 31.

Figure 19:
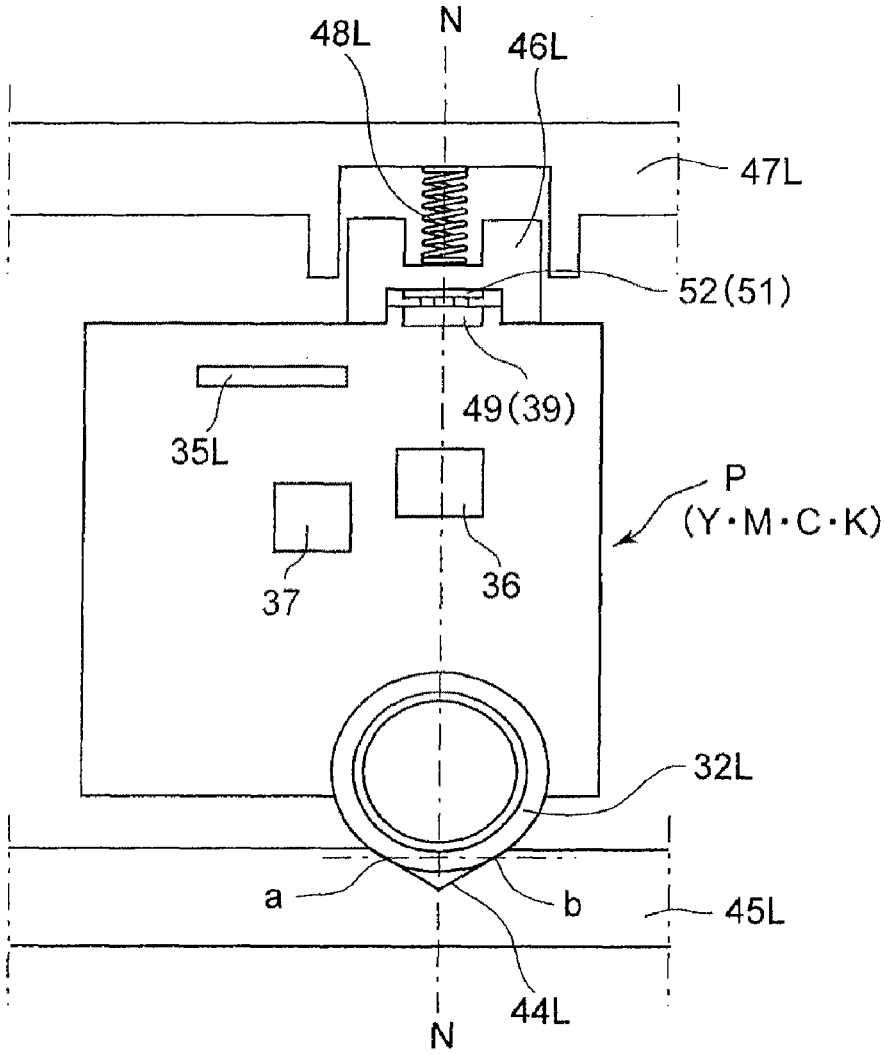
FIG. 19 is a side view of the cartridge positioning portion, and the substrate having the fourth electrical contact of the cartridge, showing the relationship between the cartridge positioning portion and substrate.

Referring to FIG. 19, when the cartridge is in its image forming position in the apparatus main assembly 1A, the center line of the substrate 49 coincides with the perpendicular bisector N of the line connecting the two points at which the arcuate cartridge supporting portion 32L of the cartridge is supported by the cartridge positioning portion 44L of the apparatus main assembly 1A, which is in the form of a groove with the V-shaped cross-section. That is, the cartridge supporting portions 32L and 32R of the cartridge serve as bearings which support the drum 4 so that the rotational center (axial line a-a) of the drum 4 coincides with the abovementioned perpendicular bisector N.

Figure 20:
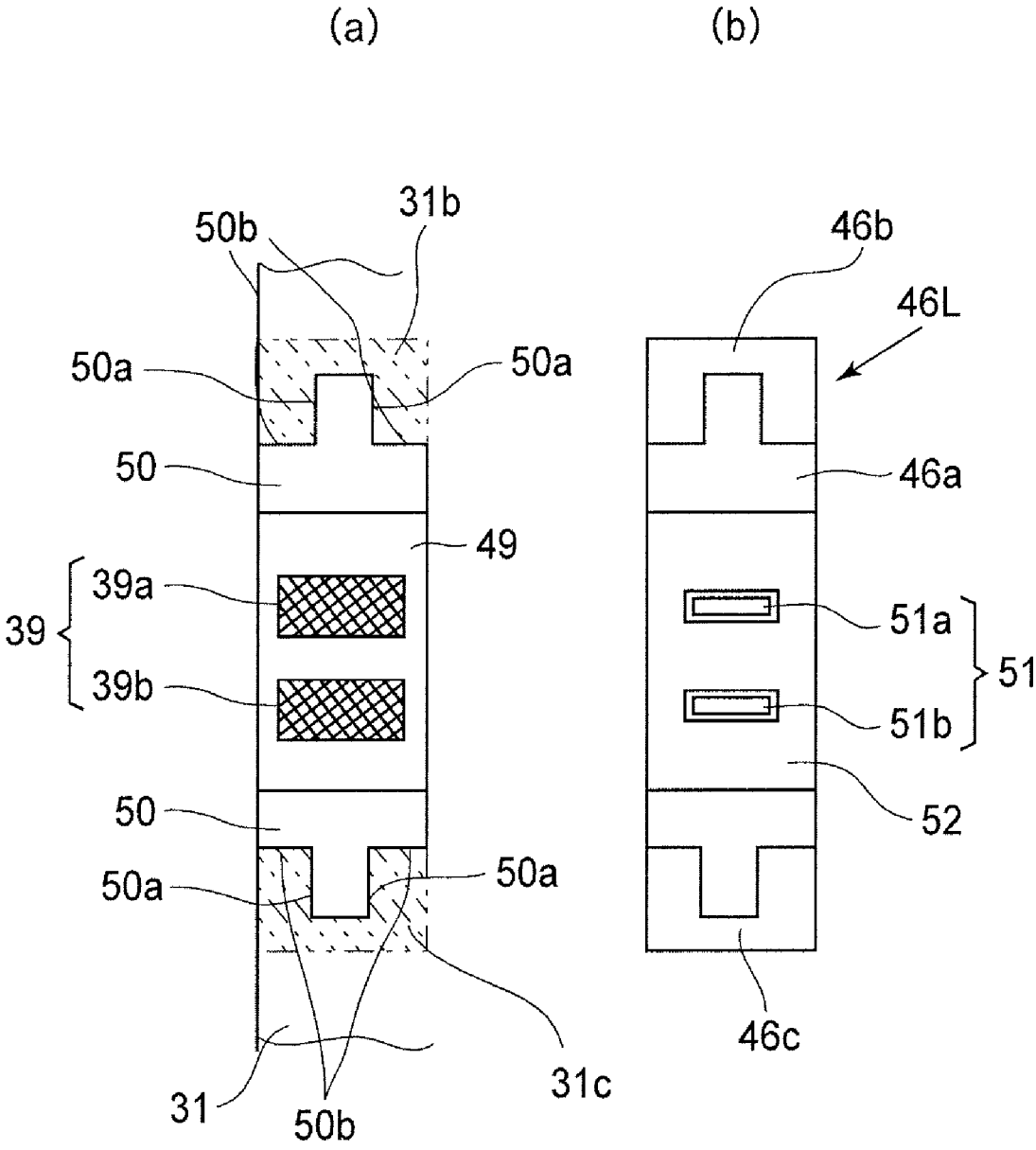
FIG. 20(*a*) is a top view of the substrate of the memory chip of the cartridge, and protrusions 50 and 50 of the cartridge, and FIG. 20(*b*) is a bottom view of the cartridge pressing member of the apparatus main assembly 1A.

The cartridge pressing member 46L of the apparatus main assembly 1A, which is on the non-driven side, corresponds in position to the substrate 49 and protrusions 50 and 50 on the cartridge. The bottom surface of the cartridge pressing member 46L has a groove 46*a*, which is rectangular in cross-section, and into which the substrate 49 and protrusions 50 and 50 on the top surface of the cartridge fit. FIG. 20(*a*) is a top view of the substrate 49 and protrusions 50 and 50 of the cartridge, and FIG. 20(*b*) is a bottom view of the cartridge pressing member 46 L of the apparatus main assembly 1A. The cartridge pressing member 46L of the apparatus main assembly 1A is provided with an electrical contact 51, which is on the bottom surface of the groove 46*a* of the cartridge pressing member 46L. The electrical contact 51 of the apparatus main assembly 1A is made up of a pair of contact points 51*a* and 51*b* (end portions of electrical contact), which are exposed at the top surface of a substrate 52 and are electrically in connection to the control portion 2 through a pair of lead wires (unshown).

When the cartridge is in the image forming position in the apparatus main assembly 1A, the cartridge pressing member 46L of the apparatus main assembly 1A, the substrate 49, and protrusions 50 and 50 of the cartridge, are in the groove 46*a* of the apparatus main assembly 1A, and the areas 46*b* (first urging portion) and 46*c* (second urging portion) of the downwardly facing surface of the cartridge pressing member 46L of the apparatus main assembly 1A is in contact with the areas 31*b* (first portion-to-be-urged) and 31*c* (second portion-to-be-urged) of the upwardly facing surface of the cartridge. Thus, the cartridge remains pressured by the cartridge pressing member 46L of the apparatus main assembly 1A which is under the pressure applied thereto by the reactive force generated by the compression of the elastic member 48L.

The areas 46*b* and 46*c* of the bottom surface of the cartridge pressing member 46L of the apparatus main assembly 1A are the bottom surfaces of the lengthwise end portions of the cartridge pressing member 46L, in terms of the direction perpendicular to the axial line of the drum 4. They oppose each other across the gap in which the substrate 52 fits. The area 46*b* is the first pressing portion, and the area 46*c* is the second pressing portion.

Further, the areas 31*b* and 31*c* of the top surface of the cartridge, which are pressed by the first and second pressing portions 46*b* and 46*c*, are the first and second portions of the cartridges, by which the cartridge is pressed by the cartridge pressing member 46L of the apparatus main assembly 1A. The substrate 49 having the electrical contact 39 (which has contact points 39*a* and 39*b*) of the cartridge, and the protrusions 50 and 50 of the cartridge, are located between the abovementioned first and second areas 31*b* and 31*c*.

When the cartridge is in the image forming position in the apparatus main assembly 1A, the electrical contact 39 (which has contacts points 39*b* and 39*c*) are electrically in contact with the electrical contact 51 (which has contact points 51*a* and 51*b*), respectively, making it possible for the control portion 2 of the apparatus main assembly 1A and the memory chip M of the cartridge to communicate with each other.

The protrusions 50 and 50 of the cartridge have first positioning portions 50*a* and 50*a*, one for one, which are for correctly positioning the cartridge pressing member 46L of the apparatus main assembly 1A, in terms of the direction parallel to the axial line of the drum 4, by fitting into the groove 46*a* of the cartridge pressing member 46L of the apparatus main assembly 1A. They also have second positioning portions 50*b* and 50*b*, one for one, which are for correctly positioning the cartridge pressing member 46L of the apparatus main assembly 1A in terms of the direction perpendicular to the axial line of the drum 4. The height of the first positioning portion 50*a* and the height of the second positioning portion 50*b* are such that they correctly position the cartridge pressing member 46L of the apparatus main assembly 1A before the electrical contact 51 (which has contact points 51*a* and 51*b*) comes into contact with the electrical contact 39 (which has contact points 39*a* and 39*b*).

As the door 3 is opened, the cartridge pressing member holding member 47L is moved upward by the movement of the door 33. As a result, the cartridge pressing members 46L of the apparatus main assembly 1A are separated from the cartridge; the cartridge is freed from the pressure applied by the cartridge pressing member 46L, and the electrical contact 51 (which has contact points 51*a* and 51*b*) of the apparatus main assembly 1A is disconnected from the electrical contact 39 (which has contact points 39*a* and 39*b*).

Figure 21:
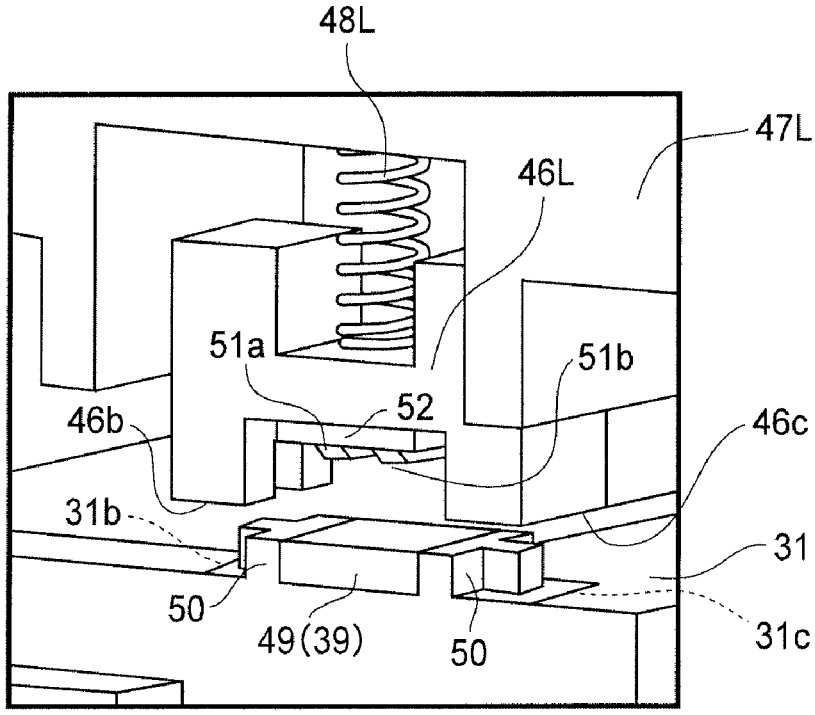
FIG. 21 is a perspective view of the electrical contact of the apparatus main assembly, and the fourth electrical contact of the cartridge, which are not in contact with each other.
Figure 22:
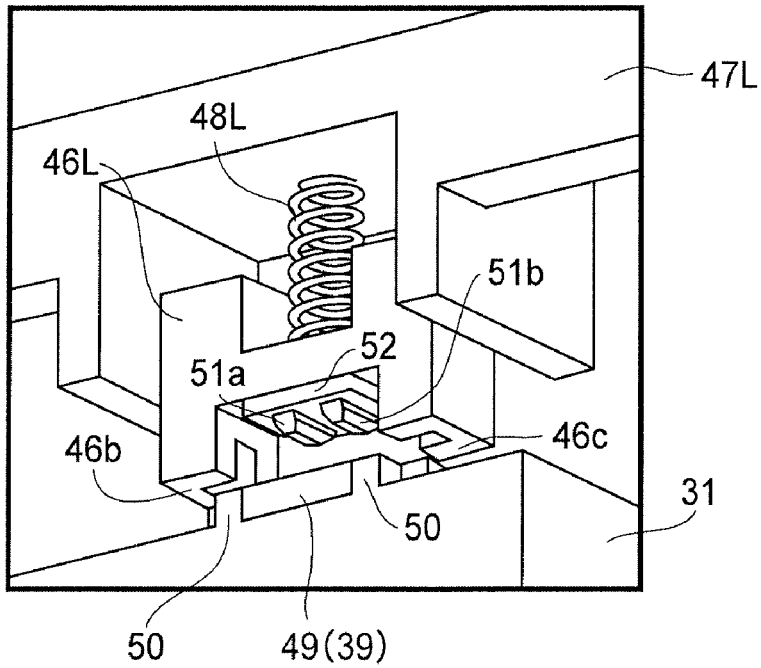
FIG. 22 is a perspective view (as seen from an angle different from the angle from which they are seen in FIG. 21) of the electrical contact of the apparatus main assembly, and the fourth electrical contact of the cartridge, which are not in contact with each other.
Figure 23:
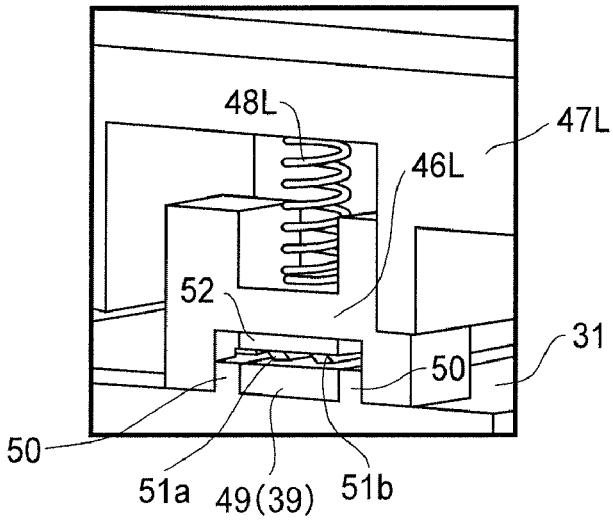
FIG. 23 is a perspective view of the electrical contact of the apparatus main assembly, and the fourth electrical contact of the cartridge, which are in contact with each other.

FIGS. 21 and 22 are perspective views of the cartridge pressing member 46L of the apparatus main assembly 1A, the electrical contact 51 (which has contact points 51*a* and 51*b*) of the apparatus main assembly 1A, the electrical contact 39 (which has contact points 39*a* and 39*b*) of the cartridge, and their adjacencies, in which the cartridge pressing member 46L is not in contact with the cartridge, and the electrical contact 51 is not in contact with the electrical contact 39. FIG. 23 is a perspective view of the cartridge pressing member 46L of the apparatus main assembly 1A, the electrical contact 51 (which has contact points 51*a* and 51*b*) of the apparatus main assembly 1A, the electrical contact 39 (which has contact points 39*a* and 39*b*) of the cartridge, and their adjacencies, in which the cartridge pressing member 46L is in contact with the cartridge, and therefore, the electrical contact 51 is electrically in contact with the electrical contact 39.

In consideration of the positioning of the electrical contacts of the cartridge and the electrical contacts of the apparatus main assembly 1A, and the positioning of the areas of the cartridge, which are to be pressed by the cartridge pressing portions of the apparatus main assembly 1A, relative to the apparatus main assembly 1A, the image forming apparatus is structured so that the cartridge pressing portions of the apparatus main assembly 1A follow the movement of the cartridge. The electrical contact 39 of the cartridge is placed between the first and second areas 31*b* and 31*c* of the cartridge, which are pressed by the cartridge pressing portions of the apparatus main assembly 1A. Therefore, the distance between the electrical contact 39 of the cartridge and the electrical contact 51 of the apparatus main assembly 1A remains stable. Therefore, the changes in the contact pressure between the electrical contact 39 of the cartridge and the electrical contact 51 of the apparatus main assembly 1A is minimized, making it possible to stabilize the state of contact between the electrical contact of the cartridge and the electrical contact of the apparatus main assembly 1A.

Further, the pressure applied to press the cartridge is utilized to keep the electrical contact 39 of the cartridge pressed on the electrical contact 51 of the apparatus main assembly 1A, making it possible to reduce an image forming apparatus in size.

The image forming apparatus is structured so that the cartridge pressing member 46L of the apparatus main assembly 1A is effective to keep the electrical connection by the electrical contact position regulating portion of the cartridge with respect to the axial direction of the drum 4 and to the direction perpendicular to the axial line of the drum 4. That is, the image forming apparatus is structured so that as the cartridge moves (as electrical contact of cartridge moves), the electrical contact 51 of the cartridge pressing member 46L of the apparatus main assembly 1A follows the movement of the cartridge (movement of electrical contact of cartridge). This structural arrangement makes it possible to reduce the positional deviation of the electrical contact 39 of the cartridge and the electrical contact 51 of the apparatus main assembly 1A relative to each other, in terms of the direction in which the electrical contacts 39 and 51 are possibly sheared by the friction between the electrical contacts 39 and 51, making it therefore possible to minimized the amount by which the electrical contacts 39 and 51 are shaved by each other due to the presence of the friction between the electrical contacts 39 and 51 in the direction in which the electrical contacts 39 and 51 are possibly sheared. Therefore, it is possible to stabilize the state of contact between the electrical contact 39 of the cartridge and the electrical contact 51 of the apparatus main assembly 1A.

Figure 24:
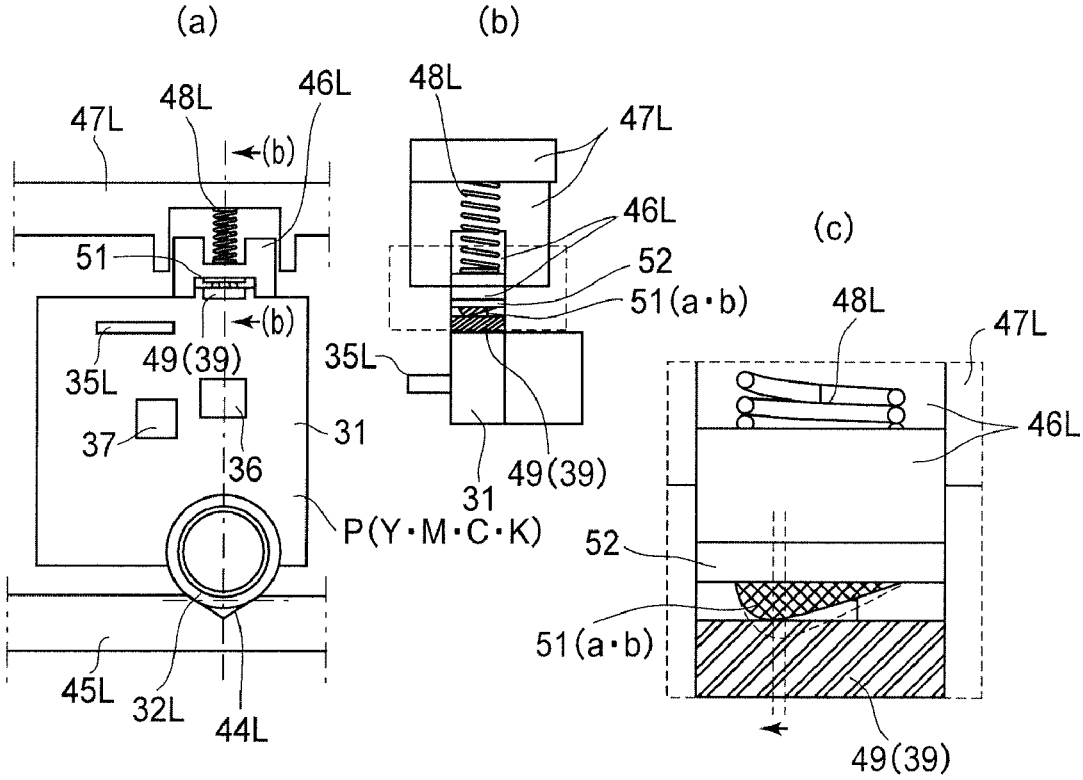
FIGS. 24(*a*) through 24(*c*) are schematic drawings of the elastic (springy) electrical contact of the apparatus main assembly, and its adjacencies, depicting the conforming capability and wiping function of the springy electrical contact of the apparatus main assembly.

Further, referring to FIG. 24, the end portions 51*a* and 51*b* (contact points) of the electrical contact 51 of the apparatus main assembly 1A are rendered elastic (springy), being therefore capable of conforming to the end portion 39*a* and 39*b* (contact points) of the electrical contact 39 of the cartridge. Further, as the end portions 51*a* and 51*b* (contact points) of the electrical contact 51 of the apparatus main assembly 1A come into contact with the end portions 39*a* and 39*b* (contact points) of the electrical contact 39 of the cartridge, the former slide on the latter, functioning as a wiper for removing the foreign substances on the surfaces of the end portions 39*a* and 39*b* (contact points) of the electrical contact 39 of the cartridge. FIG. 24(*b*) is a sectional enlargement of the portion of FIG. 24(*a*), indicated by a line (b)-(b) in FIG. 24(*a*), at a plane which coincides with, and is perpendicular to, the line (b)-(b). FIG. 24(*c*) is an enlargement of the portion of FIG. 24(*b*) that is surrounded by a broken line in FIG. 24(*b*).

As described above, in this embodiment, the electrical contact 49 of the cartridge is placed between the first and second areas of the top surface of the cartridge, which catch the pressure applied to the cartridge by the apparatus main assembly 1A. Therefore, the image forming apparatus is improved in terms of the stability in the state of contact between the electrical contact 49 of the cartridge and the electrical contact 51 of the apparatus main assembly 1A. Further, it is possible to reduce in size the cartridge and the image forming apparatus.

Incidentally, in the above described embodiment of the present invention, the image forming apparatus is structured so that the tray 29 is moved in a straight line in the direction parallel to the surface on which the apparatus main assembly 1A was set. However, the direction in which the movable member, or the tray 29, is moved does not need to be limited to the abovementioned direction. For example, the image forming apparatus may be structured so that the tray 29 moves in a straight line in the upwardly or downwardly slanting direction relative to the surface on the apparatus main assembly 1A is set. Needless to say, even in such a case, the image forming apparatus is structured so that the tray 29 is moved downward after being moved in a straight line.

As described above, according to the present invention, a process cartridge and an image forming apparatus can be improved in terms of the stability in the state of contact between the electrical contacts of the cartridge and the electrical contacts of the apparatus main assembly.

Further, according to the present invention, a process cartridge and an image forming apparatus can be reduced in size.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 355651/2006 filed Dec. 28, 2006 which is hereby incorporated by reference.

What is claimed is:

1. A process cartridge detachably mountable to a main assembly of the apparatus of an image forming apparatus, said image forming apparatus including a main assembly urging member and a main assembly positioning portion, said process cartridge comprising:

a photosensitive drum rotatable around an axis passing therethrough;

a portion-to-be-positioned that positions said process cartridge by engaging with the main assembly positioning portion when said process cartridge is mounted to the main assembly of the apparatus;

a first portion-to-be-urged for being urged by a first urging portion of the main assembly urging member to urge said portion-to-be-positioned to the main assembly positioning portion when said process cartridge is mounted to the main assembly of the apparatus;

a second portion-to-be-urged for being urged by a second urging portion of the main assembly urging member to urge said portion-to-be-positioned to the main assembly positioning portion when said process cartridge is mounted to the main assembly of the apparatus; and a cartridge electrical contact, provided between said first portion-to-be-urged and said second portion-to-be-urged, which are aligned in a direction crossing the rotational axis of said photosensitive drum, that electrically connects to a main assembly electrical contact portion provided in the main assembly urging member, when said process cartridge is mounted to the main assembly of the apparatus.

2. A process cartridge according to claim 1, wherein in a state in which said process cartridge is mounted to the main assembly of the apparatus, said portion-to-be-positioned is disposed at a position on said process cartridge that is lower than the position of said first portion-to-be-urged, said second portion-to-be-urged and said cartridge electrical contact on said cartridge.

3. A process cartridge according to claim 1, wherein said portion-to-be-positioned is supported by the main assembly positioning portion at two points, and a substrate having said cartridge electrical contact is disposed on a perpendicular bisector of a line connecting of the two points.

4. A process cartridge according to claim 3, wherein said portion-to-be-positioned is a shaft receiving portion that supports said photosensitive drum whose rotational axis passes through the perpendicular bisector.

5. A process cartridge according to claim 1, further comprising a projection including a first positioning portion that positions the main assembly urging member with respect to the direction of the axis of said photosensitive drum and a second positioning portion that positions the main assembly urging member with respect to a direction crossing the direction of the axis of said photosensitive drum.

6. A process cartridge according to claim 5, wherein said projection is provided at each side of a substrate on which said cartridge electrical contact is disposed with respect to the horizontal direction.

7. A process cartridge according to claim 5 or 6, wherein said first positioning portion and said second positioning portion have a sufficient height to position the main assembly urging member before the main assembly electrical contact portion contacts said cartridge electrical contact.

8. An image forming apparatus, to which a process cartridge is detachably mountable, for forming an image on a recording material, said image forming apparatus comprising:

(i) a main assembly urging member including a first urging portion, a second urging portion, and a main assembly electrical contact portion;

(ii) a main assembly positioning portion that positions the process cartridge when the process cartridge is mounted to a main assembly of said image forming apparatus;

(iii) a photosensitive drum rotatable around an axis passing therethrough; and (iv) a mounting member that detachably mounts the process cartridge, the process cartridge including a portion-to-be-positioned that positions the process cartridge by engaging with said main assembly positioning portion when the process cartridge is mounted to the main assembly of said image forming apparatus, a first portion-to-be-urged being urged to said first urging portion of the main assembly urging member to urge the portion-to-be-positioned to said main assembly positioning portion when the process cartridge is mounted to the main assembly of said apparatus, a second portion-to-be-urged being urged to said second urging portion of said main assembly urging member to urge the portion-to-be-positioned to said main assembly positioning portion when the process cartridge is mounted to the main assembly of said apparatus, and a cartridge electrical contact, provided between the first portion-to-be-urged and the second portion-to-be-urged, which are aligned in a direction crossing the rotational axis of said photosensitive drum, that electrically connects to said main assembly electrical contact portion provided in said main assembly urging member, when the process cartridge is mounted to the main assembly of said apparatus.

9. An apparatus according to claim 8, further comprising a drawer member movable between a mounting position which is inside of the main assembly of said apparatus and a drawn position which is drawn from the mounting position and at which the process cartridge is mountable.

10. An apparatus according to claim 9, wherein said drawer member is capable of mounting a plurality of such process cartridges.

11. An apparatus according to claim 9 or 10, wherein, said drawer member is movable relative to the main assembly of said apparatus substantially in a horizontal direction which crosses the rotational axis of said photosensitive drum.

* * * * *